US010373437B2

(12) United States Patent
Berman

(10) Patent No.: US 10,373,437 B2
(45) Date of Patent: Aug. 6, 2019

(54) GAMING METHODS, SYSTEMS, AND DEVICES FOR IMPLEMENTING DICE GAME HAVING RE-ROLL FEATURE

(71) Applicant: KING SHOW GAMES, INC., Minnetonka, MN (US)

(72) Inventor: Bradley Berman, Minnetonka, MN (US)

( * ) Notice: Subject to any disclaimer, the term of this patent is extended or adjusted under 35 U.S.C. 154(b) by 0 days.

(21) Appl. No.: 15/661,089

(22) Filed: Jul. 27, 2017

(65) Prior Publication Data

US 2017/0323527 A1 Nov. 9, 2017

Related U.S. Application Data

(63) Continuation of application No. 14/486,315, filed on Sep. 15, 2014, now Pat. No. 9,721,432.

(51) Int. Cl.
*G07F 17/32* (2006.01)

(52) U.S. Cl.
CPC ..... *G07F 17/3262* (2013.01); *G07F 17/3213* (2013.01); *G07F 17/3267* (2013.01); *G07F 17/3293* (2013.01)

(58) Field of Classification Search
CPC ..... G07F 17/3262; G07F 17/3213; G07F 17/3267
USPC ..... 463/13
See application file for complete search history.

(56) References Cited

U.S. PATENT DOCUMENTS 3,791,650 A 2/1974 Dice
4,258,919 A 3/1981 Martelli
4,700,948 A * 10/1987 Okada ..... G07F 17/34 273/143 R
5,125,660 A 6/1992 Stahl
5,415,412 A 5/1995 Mcmahon
5,791,649 A 8/1998 Disandro
6,123,333 A 9/2000 McGinnis et al.
6,173,955 B1 1/2001 Perrie et al.
6,428,005 B2 8/2002 Au-Yeung
6,565,088 B2 5/2003 Perrie et al.
6,746,016 B2 6/2004 Perrie et al.
7,001,275 B2 2/2006 Mccall
7,004,836 B2 2/2006 Kaminkow et al.
7,316,397 B2 * 1/2008 Friedman ..... A63F 3/00157 273/274
7,871,077 B2 1/2011 Calvert
7,931,275 B1 4/2011 Strickland
8,074,986 B1 12/2011 Gebhart
(Continued)

OTHER PUBLICATIONS

KSG, "Listing of Related Cases," Jul. 27, 2017, 1 Page.

*Primary Examiner* — Omkar A Deodhar
*Assistant Examiner* — Shauna-Kay Hall

(57) ABSTRACT

Embodiments of the present invention set forth systems, apparatuses and methods for implementing a dice game having a re-roll feature on a gaming device. Accordingly, a gaming device can be configured to roll multiple virtual dice on a game display and determine if the result of the dice roll satisfies a predefined criterion. When the result of the initial dice roll satisfies the predefined criterion, one or more of the multiple virtual dice is re-rolled. The gaming device then evaluates a game result after the re-roll, where the combination of the displayed faces from any initially rolled dice that were not re-rolled and the displayed faces from the re-rolled dice are used in the evaluation.

20 Claims, 14 Drawing Sheets

(56) References Cited

U.S. PATENT DOCUMENTS

| | | | | |
|---|---|---|---|---|
| 8,133,111 | B2 | 3/2012 | Thomas | |
| D658,723 | S | 5/2012 | Rinpoche | |
| 2004/0002376 | A1* | 1/2004 | Swift | G07F 17/3244 463/25 |
| 2004/0127275 | A1 | 7/2004 | McCall | |
| 2004/0229670 | A1 | 11/2004 | Potter et al. | |
| 2007/0052174 | A1 | 3/2007 | Dargue | |
| 2007/0066380 | A1 | 3/2007 | Miura | |
| 2008/0012231 | A1 | 1/2008 | Dargue | |
| 2013/0310126 | A1* | 11/2013 | Daniels | G07F 17/3293 463/13 |

* cited by examiner

GAMING METHODS, SYSTEMS, AND DEVICES FOR IMPLEMENTING DICE GAME HAVING RE-ROLL FEATURE

This application is a continuation of U.S. application Ser. No. 14/486,315, filed Sep. 15, 2014, now U.S. Pat. No. 9,721,432, which is incorporated herein by reference in its entirety.

FIELD OF THE INVENTION

Background

Casino games such as poker, slots, and craps have long been enjoyed as a means of entertainment. Almost any game of chance that can be played using traditional apparatus (e.g., cards, dice) can be simulated on a computer. The popularity of casino gambling with wagering continues to increase, as does recreational gambling such as non-wagering computer game gambling. It is also likely that most new games will be implemented, at least in part, using computerized apparatus.

One reason that casino games are widely implemented on computerized apparatus is that computerized games are highly adaptable, easily configurable and re-configurable, and require minimal supervision to operate. For example, the graphics and sounds included in such games can be easily modified to reflect popular subjects, such as movies and television shows.

Computer gaming devices can also be easily adapted to provide entirely new games of chance that might be difficult to implement using mechanical or discrete electronic circuits. Because of the ubiquity of computerized gaming machines, players have come to expect the availability of an ever wider selection of new games when visiting casinos and other gaming venues. Playing new games adds to the excitement of "gaming" As is well known in the art and as used herein, the term "gaming" and "gaming devices" generally involves some form of wagering, and that players make wagers of value, whether actual currency or something else of value, e.g., token or credit. Wagering-type games usually provide rewards based on random chance as opposed to skill. In some jurisdictions, the absence of skill when determining awards during game play is a requirement.

The present disclosure describes methods, systems, and apparatus that provide for new and interesting gaming experiences, and that provide other advantages over the prior art.

SUMMARY

To overcome limitations in the prior art described above, and to overcome other limitations that will become apparent upon reading and understanding the present specification, embodiments of the present invention are directed to an apparatus, system, computer readable storage media, and/or method that involve or otherwise facilitate implementation of a dice game having a re-roll feature. In one embodiment, a method of operating a gaming device includes receiving a signal to initiate a gaming event, rolling a plurality of virtual dice on a gaming display of the gaming device, determining an outcome of the gaming event, and visually manipulating the virtual dice on the gaming display to reflect the determined game outcome. The method of this embodiment further includes determining if the game outcome satisfies a predefined criterion. When the game outcome does satisfy the predefined criterion, one or more of the displayed virtual dice is re-rolled. A re-roll outcome for these re-rolled dice is determined, and a new determination is made for a final game outcome that includes the outcome of any virtual dice from the original game outcome that were not re-rolled and the outcome of the re-rolled dice.

DETAILED DESCRIPTION

Figure 1:
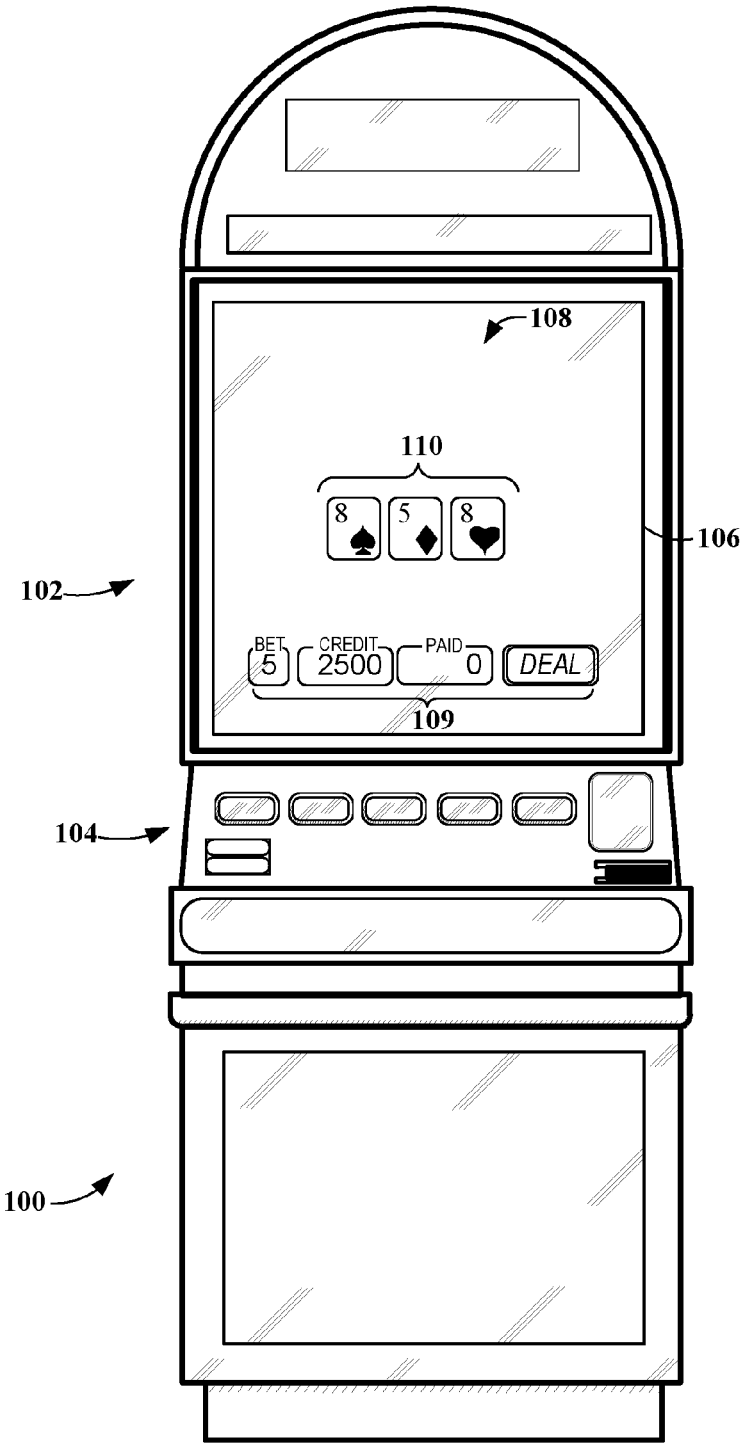
FIG. 1 is a diagram of a gaming machine according to embodiments of the invention.

In the following description of various exemplary embodiments, reference is made to the accompanying drawings which form a part hereof, and in which is shown by way of illustration representative embodiments in which the features described herein may be practiced. It is to be understood that other embodiments may be utilized, as structural and operational changes may be made without departing from the scope of the disclosure.

In the description that follows, the terms "reels," "cards," "decks," and similar mechanically descriptive language may be used to describe various apparatus presentation features, as well as various actions occurring to those objects (e.g., "spin," "draw," "hold," "bet"). Although the present disclosure may be applicable to manual, mechanical, and/or computerized embodiments, as well as any combination therebetween, the use of mechanically descriptive terms is not meant to be only applicable to mechanical embodiments. Those skilled in the art will understand that, for purposes of providing gaming experiences to players, mechanical elements such as cards, reels, and the like may be simulated on a display in order to provide a familiar and satisfying experience that emulates the behavior of mechanical objects, as well as emulating actions that occur in the non-computerized games (e.g., spinning, holding, drawing, betting). Further, the computerized version may provide the look of mechanical equivalents but may be generally randomized in a different way. Thus, the terms "cards," "decks," "reels," "hands," etc., are intended to describe both physical objects and emulation or simulations of those objects and their behaviors using electronic apparatus.

In various embodiments of the invention, the gaming displays are described in conjunction with the use of data in the form of "symbols." In the context of this disclosure, a "symbol" may generally refer at least to a collection of one or more arbitrary indicia or signs that have some conventional significance. In particular, the symbol represents values that can at least be used to determine whether to award a payout. A symbol may include numbers, letters, shapes, pictures, textures, colors, sounds, etc., and any combination therebetween. A win can be determined by comparing the symbol with another symbol. Generally, such comparisons can be performed via software by mapping numbers (or other data structures such as character strings) to the symbols and performing the comparisons on the numbers/data structures. Other conventions associated with known games (e.g., the numerical value/ordering of face cards and aces in card games) may also be programmatically analyzed to determine winning combinations.

Generally, systems, apparatuses and methods are described for enhancing winning result opportunities in gaming activities. The systems, apparatuses and methods described herein may be implemented as a single game, or part of a multi-part game. For example, the game features described herein may be implemented in primary gaming activities, bonus games, side bet games or other secondary games associated with a primary gaming activity. The game features may be implemented in stand-alone games, multi-player games, etc. Further, the disclosure may be applied to games of chance, and descriptions provided in the context of any representative game (e.g. slot game) are provided for purposes of facilitating an understanding of the features described herein. However, the principles described herein are equally applicable to any game of chance where an outcome(s) is determined for use in the player's gaming activity.

Embodiments of the present invention are directed to an apparatus, system, computer readable storage media, and/or method that involve or otherwise facilitate implementation of a dice game having a re-roll feature. Here, a dice game refers to any gaming event that utilizes one or more multi-positional game elements. For ease of reference, the term "dice" is used to represent all different types of multi-positional game elements, including types of multi-positional game elements that may not necessarily be considered "dice," such as two dimensional objects that display different symbols or markings on each of the two sides of the object.

As this disclosure relates to multi-positional game elements, it hereby incorporates U.S. patent application Ser. No. 14/015,473 entitled "GAMING DEVICE HAVING MULTI-POSITIONAL GAME ELEMENTS," filed Aug. 30, 2013 (published as US 2014/0087833) in its entirety.

In one embodiment, a method of operating a gaming device includes receiving a signal to initiate a gaming event, rolling a plurality of virtual dice on a gaming display of the gaming device, determining an outcome of the gaming event, and visually manipulating the virtual dice on the gaming display to reflect the determined game outcome. The method of this embodiment further includes determining if the game outcome satisfies a predefined criterion. When the game outcome does satisfy the predefined criterion, one or more of the displayed virtual dice is re-rolled. A re-roll outcome for these re-rolled dice is determined, and a new determination is made for a final game outcome that includes the outcome of any virtual dice from the original game outcome that were not re-rolled and the outcome of the re-rolled dice.

In another embodiment, a method of implementing a gaming event on a gaming device having a game display and a processor is provided. Here, the method includes providing a first game element having a plurality of positions, providing a second game element having a plurality of positions, selecting symbols from a plurality of eligible symbols to map to the positions of the first game element and the positions of the second game element, and randomizing the first game element and the second game element to display at least one position of the first game element and display at least one position of the second game element to form a first event outcome. After forming the first event outcome, the method further includes evaluating the one or more symbols associated with the displayed position of the first game element, re-randomizing the second game element to display at least one position of the second game element to form a second event outcome when the one or more symbols on the evaluated displayed position of the first game element satisfies a predefined condition, and evaluating the one or more symbols respectively associated with the displayed positions of the first game element and the second game element in the second event outcome to determine awards.

In some embodiments, the method further includes providing a third game element having a plurality of positions, selecting symbols from the plurality of eligible symbols to map to the positions of the third game element, and randomizing the third game element with the first game element and second game element to display at least one position of the third game element as part of the formation of the first game outcome. Here, after the first game outcome is formed, the method further includes evaluating the one or more symbols on the display position of the third game element with the symbols of the first game element, re-randomizing the second game element to display at least one position of the second game element to form the second event outcome when the combination of the evaluated symbols of the first game element and third game element satisfy a predefined condition, and evaluating the one or more symbols respectively associated with the displayed positions of the first game element, the second game element, and the third game element in the second event outcome to determine awards.

In one variation of the above methods, the plurality of eligible symbols may be a deck of playing cards. Additionally, evaluating the one or more symbols on the first game element and the third game element may include determining if the displayed playing cards on the first game element and the third game element form a poker hand that satisfies a minimum poker threshold according to a predefined poker paytable.

Numerous variations are possible using these and other embodiments of the inventive concept. Some of these embodiments and variations are discussed below with reference to the drawings. However, many other embodiments and variations exist that are covered by the principles and scope of this concept. For example, although some of the embodiments discussed below involve reel-based slot machine examples of this concept, other embodiments include application of these inventive techniques in other types of slot games, poker games, or other games of chance. Some of these other types of embodiments will be discussed below as variations to the examples illustrated. However, many other types of games can implement similar techniques and fall within the scope of this inventive concept.

A representative embodiment for using multi-positional game elements is shown in FIG. 1. Referring to the example gaming apparatus 100 shown in FIG. 1, the gaming apparatus includes a display area 102 (also referred to as a gaming display), and a player interface area 104, although some or all of the interactive mechanisms included in the user interface area 104 may be provided via graphical icons used with a touch screen in the display area 102 in some embodiments. The display area 102 may include one or more game displays 106 (also referred to as "displays" or "gaming displays") that may be included in physically separate displays or as portions of a common large display. Here, the game display 106 includes a primary game play portion 108 that displays game elements and symbols 110, and an operations portion 109 that can include meters, various game buttons, or other game information for a player of the gaming device 100.

The user interface 104 allows the user to control and engage in play of the gaming machine 100. The particular user interface mechanisms included with user interface 104 may be dependent on the type of gaming device. For example, the user interface 104 may include one or more buttons, switches, joysticks, levers, pull-down handles, trackballs, voice-activated input, or any other user input system or mechanism that allows the user to play the particular gaming activity.

The user interface 104 may allow the user or player to enter coins, bills, or otherwise obtain credits through vouchers, tokens, credit cards, tickets, etc. Various mechanisms for entering such vouchers, tokens, credit cards, coins, tickets, etc. are known in the art. For example, coin/symbol input mechanisms, card readers, credit card readers, smart card readers, punch card readers, radio frequency identifier (RFID) readers, and other mechanisms may be used to enter wagers. It is through the user interface 104 that the player can initiate and engage in gaming activities. While the illustrated embodiment depicts various buttons for the user interface 104, it should be recognized that a wide variety of user interface options are available for use in connection with the present invention, including pressing buttons, touching a segment of a touch-screen, entering text, entering voice commands, or other known data entry methodology.

The game display 106 in the display area 102 may include one or more of an electronic display, a video display, a mechanical display, and fixed display information, such as paytable information associated with a glass/plastic panel on the gaming machine 100 and/or graphical images. The symbols or other indicia associated with the play of the game may be presented on an electronic display device or on mechanical devices associated with a mechanical display. Generally, the display 106 devotes the largest portion of viewable area to the primary gaming portion 108. The primary gaming portion 108 is generally where the visual feedback for any selected game is provided to the user. The primary gaming portion 108 may render graphical objects such as cards, slot reels, dice, animated characters, and any other gaming visual known in the art. The primary gaming portion 108 also typically informs players of the outcome of any particular event, including whether the event resulted in a win or loss.

In some the example embodiments illustrated herein, the gaming portion 106 may display one or more multi-positional game elements 110 for use in a gaming event. Each of the multi-positional game elements 110 may include two or more positions that are assigned symbols for use in a gaming event. For example, in the illustrated gaming portion 106 shown in FIG. 1, three six-sided cubes 110 are shown as the multi-positional game elements. Here, each cube 110 includes a representative card suit and value. Thus, in this embodiment, 18 different "playing cards" are mapped to the three multi-positional game elements 110. In other embodiments, less than the total number of positions may be assigned symbols, such as card values/card suits.

When the cards are mapped to the multi-positional game elements according to one or more rules, the probability that certain card combinations occur can be influenced by the rules or selection process. In this example, the 18 cards selected and mapped can be done according to rules that encourage pairs, flushes, straights, or other card combinations. Thus, while 18 of the 52 cards (or whatever size deck is being used) are selected, each card may not have a corresponding probability of being selected as if the selection process was completely random. Since the multi-positional elements are 6-sided in this embodiment, each face of each of the dice or elements has a 1 in 6 chance of being shown as part of a game outcome. However, this two-step process of mapping the cards to the dice, and then rolling the dice does not necessarily give the same odds of having three "cards" appear as an outcome, as randomly selecting three cards in a deck to display as a hand or game outcome. This two-step process may thus be advantageous in encouraging or weighting specific types of outcomes as compared to conventional poker games.

Returning again to this illustrated embodiment, the three cubes 110, or dice, are manipulated or rolled to show an outcome of three "cards," which are represented by the face-up sides of the three cubes. These three "cards" are then evaluated relative to a paytable to determine prizes or awards. The illustration and description of this poker embodiment is for purposes of example and not of limitation; the present invention may be applicable to numerous other poker games, as well as other types of gaming activities and apparatuses, using a variety of symbols or indicia on the multi-positional game elements 110.

The gaming portion 106 may include other features known in the art that facilitate gaming, such as status and control portion 109. As is generally known in the art, this portion 109 provides information about current bets, current wins, remaining credits, etc. associated with gaming activities of the game play area 108. The control portion 109 may also provide touchscreen controls for facilitating game play. The game play area 108 may also include touchscreen features, such as facilitating selection of individual game elements for holding, rolling, or otherwise selecting or manipulating. The gaming portion 106 of the display 102 may include other features that are not shown, such as paytables, navigation controls, etc.

Embodiments of the present concept also include providing a re-roll feature for multi-positional game elements or dice. Here, multiple possible game symbols or indicia may be mapped to the one or more multi-positional game elements for use in a gaming event. In one embodiment, this procedure includes mapping playing cards to a virtual dice and allowing player to roll the dice to achieve poker hands that pay based on a paytable. In other embodiments, this procedure could include mapping other symbol sets, numerical values, etc. to dice, or other multi-positional game element. After the symbols are mapped to the multi-positional game elements, and the game elements have been rolled, it is determined if the result of the roll satisfies a re-roll condition. Re-roll conditions may include receiving an outcome combination associated with an award or win on less than the complete number of multi-positional game elements. In such an embodiment, the multi-positional game elements associated with the award or win may be held while the remaining multi-positional game elements are re-rolled.

Although six-sided cubes or virtual dice are shown in FIG. 1, any shaped multi-positional game element could be utilized. For example, a two-sided "coin" may be used in some embodiments. In other embodiments, a four-sided pyramid, a ten-sided game element, etc. could be used. The multi-positional game elements could be used in determining outcomes in a primary or base game, in determining bonus modifiers for use with the primary game outcomes, or in determining outcomes in a separate bonus game.

In some embodiments, each side of the multi-positional game element or dice may be assigned a symbol, which in other embodiments, only some of the sides or positions of the multi-positional game elements (such as the visible sides, or sides not associated with mystery outcomes) may be initially assigned symbols. In embodiments that utilize multi-positional game elements similar to dice, the dice could be typically-shaped six-sided dice, could be any other number of sided-dice. In addition, there may be 1–x number of dice used. For embodiments using "cards" as symbols in the different positions of the multi-positional game elements, the game indicia symbols being mapped to the game elements could include a standard deck of playing cards, which may or may not include jokers, or they could be a non-standard deck. In other embodiments, the symbols could be assigned from multiple decks of cards, or be assigned from a combination of cards and other symbols.

Re-roll features may be conditioned upon satisfying a re-roll condition or may be randomly provided. In some embodiments, a side wager may be required up front (such as with the original wager) to be eligible for the re-roll feature. In other embodiments, the re-roll feature may require a side bet or wager as of the time of accepting the re-roll feature. Alternatively, the re-roll feature may be present as part of the game and not include an additional wager. In some embodiments, the player may choose to accept the re-roll condition (either with or without a side bet requirement), while in other embodiments the dice are re-rolled automatically without providing an option. Re-rolling the multi-positional game elements may include randomizing the designated game elements with the existing symbols on the game elements, or may include mapping new game symbols or markings to one or more positions of the game elements prior to randomizing or re-rolling them.

Re-roll conditions, when required to provide a re-roll, may be based on the outcome of the prior roll, may be triggered by other conditions, or may be random. Multiple re-roll chances may be provided in some embodiments. These multiple re-roll chances may be sequential (i.e., the result of the previous roll or re-roll is maintained in determining which game elements to re-roll), or may be in parallel (i.e., the same original hand is used and multiple re-rolls off of the same hand may be made). Both the sequential and parallel embodiments may be allow a player multiple chances of receiving highly desirable outcomes and/or awards. In some sequential embodiments, further re-rolls may only be granted when additional game elements are held, when an intermediary outcome is better than a previous outcome (such as being associated with a higher award), or based on other criteria. Alternatively, in some embodiments a set number of re-rolls is granted. The set number of re-rolls may be one, where only a single re-roll is allowed. Additionally, the set number of re-rolls may be allocated over a single game stage or could be applied over multi-game stages in gaming events or bonus gaming events where there are multiple stages. In these embodiments, a player may decline a re-roll option in an early stage when the possibility of outcome improvement is low in hopes of having a better chance to use the re-roll in later stages or rounds where there is a higher probability of improving a game outcome. Many different variations and embodiments are possible. The following illustrated embodiments show aspects of some of these features and variations. However, individual features of these embodiments may be combinable in other embodiments without all parts of the illustrated embodiments, or additional, fewer, or different features may be implemented in other embodiments while staying within the scope of this inventive concept.

Figure 2A:
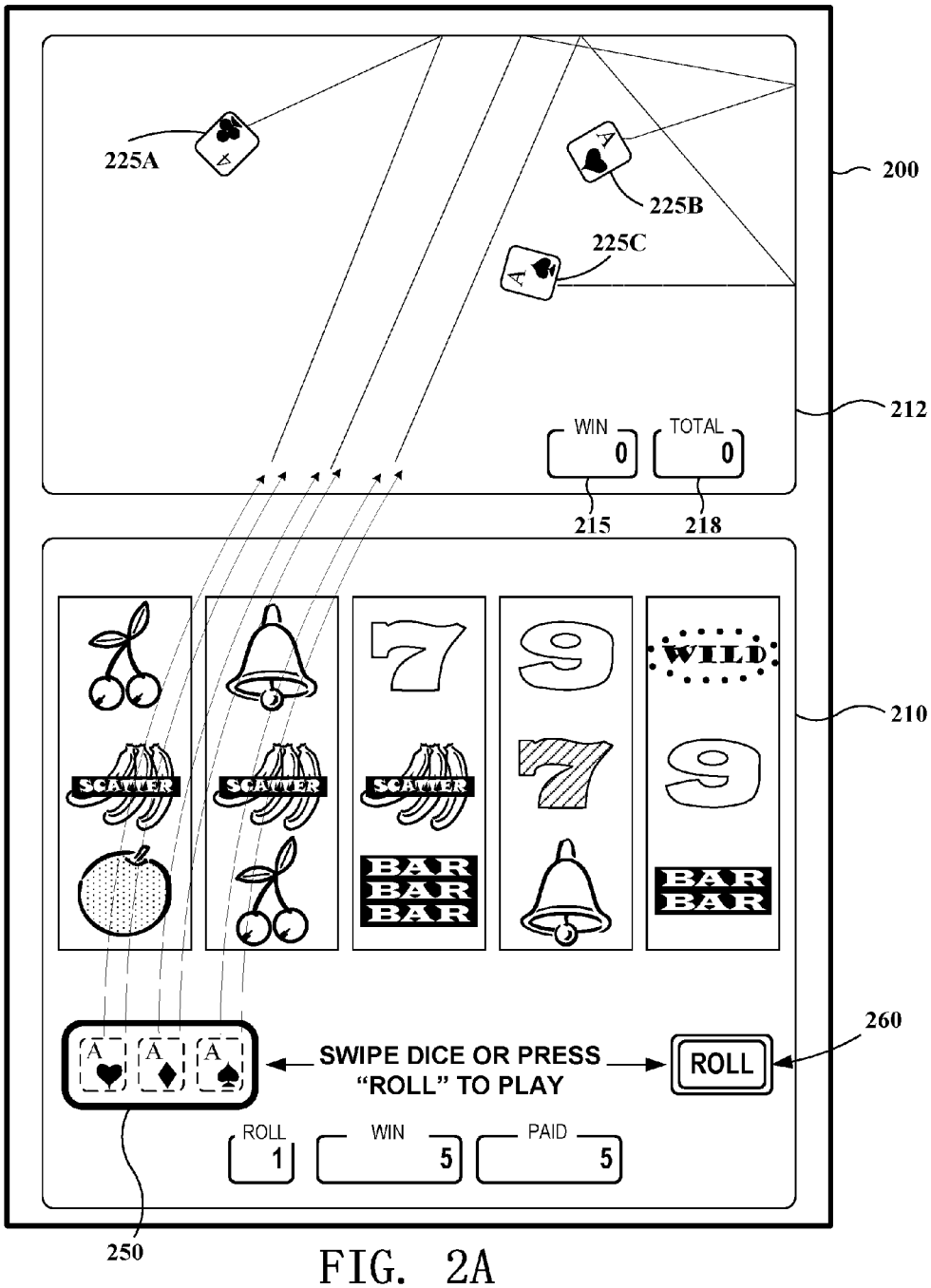
FIGS. 2A and 2B are diagrams of a game display illustrating implementation of a dice game having a re-roll feature according to embodiments of the invention.
Figure 2B:
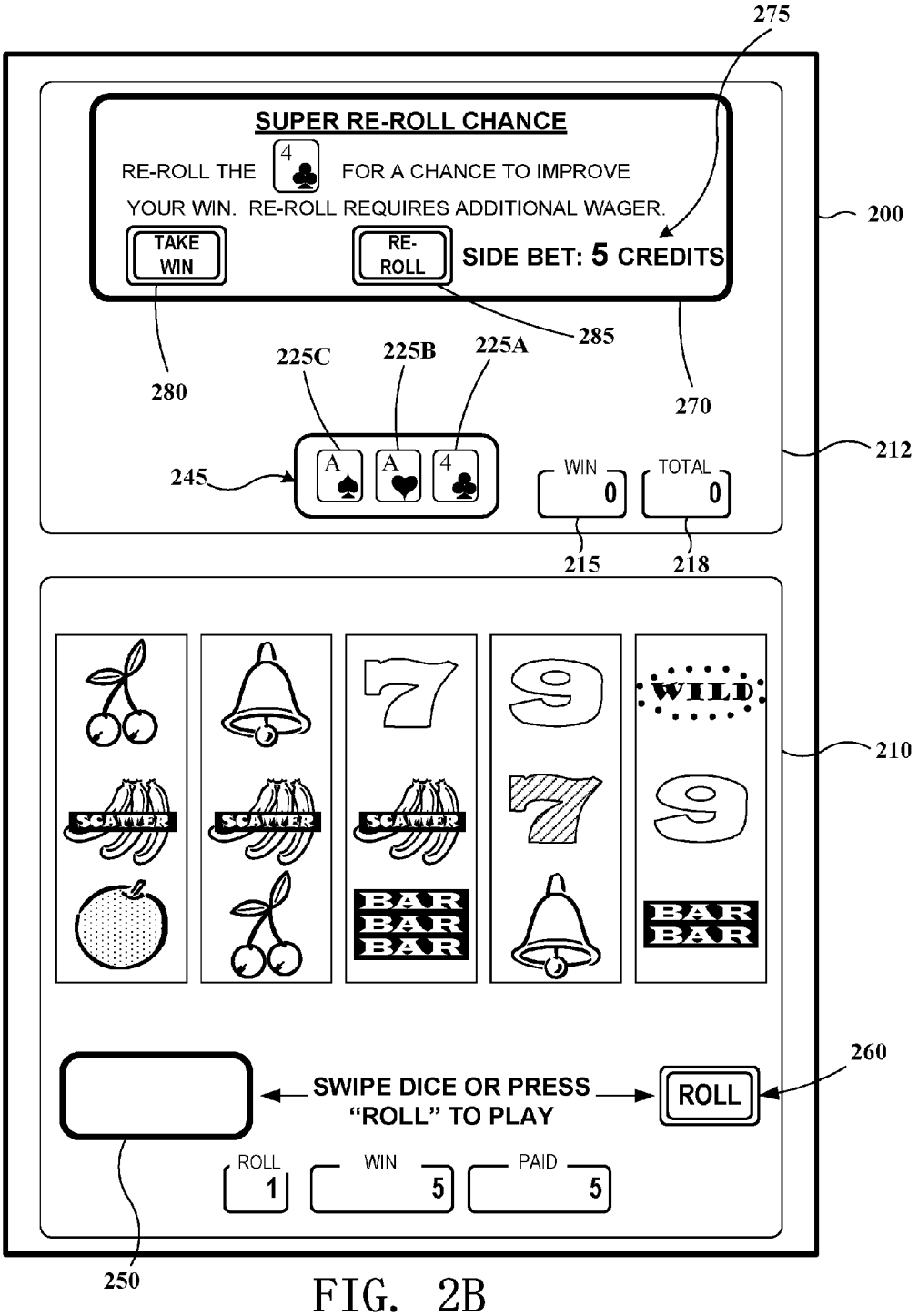

FIGS. 2A and 2B are diagrams of a game display illustrating implementation of a dice game having a re-roll feature according to embodiments of the invention.

Referring to FIG. 2A, a gaming display 200 includes a primary game portion 210 and a secondary game portion 212 (also referred to as a dice play portion). Here, the primary game portion 210 is used to play a primary or base game with a slot type game using five game reels that have 3 symbols shown in an outcome grid. The secondary game portion 212 may not be used during base game play or may be used for other purposes such as messaging or providing a game banner, game design, etc. The primary game portion 210 and secondary game portion 212 may be displayed on a single physical video screen display 200, or may be shown on separate physical video screen displays as part of the game display 200. Alternatively, one or both of the display portions may include mechanical game aspects, such as mechanical spinning reels. Additionally, although a slot-based primary game is shown in FIGS. 2A and 2B, any type of base or primary game may be used, or the dice bonus game shown here may itself by the primary or base game.

Referring again to FIG. 2A, a bonus game event has been triggered either by an outcome in the base game, or by a mystery bonus trigger. A starting dice portion 250 is shown with dice 225A, 225B, and 225C, where the player may swipe the display screen above the starting dice portion or press a "Roll" button 260 to roll the dice in the secondary game portion 212. The secondary game portion allows the dice to ricochet around and come to a rest, as well providing a "Win" meter 215 and "Total" meter 218. In this embodiment, three six-sided dice with playing card images are used in the bonus game event. In other embodiments, however, any multi-positional game elements may be used. Additionally, pips, slot symbols, playing cards, or any other type of marking may be used on each position or side of the multi-positional game elements.

As shown in FIG. 2A, the rolled dice 225A, 225B, and 225C result in the following outcomes: 4C (4 of Clubs), AH (Ace of Hearts), and AS (Ace of Spades). This outcome is evaluated to see if it meets a re-roll condition. As described herein, many different re-roll conditions may be defined or used in various embodiments. In the present embodiment, the best hand including a face card, pair of cards, sequentially ranked cards, or similarly suited cards satisfies the re-roll condition.

Referring to FIG. 2B, since the dice 225A, 225B, and 225C satisfy the re-roll condition (e.g., having a pair of Aces), the dice meeting the re-roll condition are held, and an option is provided to re-roll the remaining die or dice (here the 4C 225A). The re-roll option is provided in message box 270, which also includes a "Take Win" button 280 and a "Re-Roll" button 285. Further, as shown in FIG. 2B, taking the option to re-roll any dice requires a side bet or wager 275 which is provided in the re-roll message box 270. In some embodiments, no additional side bet or wager is needed to re-roll the dice. In other embodiments, such as the one shown in FIG. 2B, a side bet or wager is required to take a re-roll option. The amount of the required side wager may be an amount associated with the held cards (i.e., if the award for a pair of Aces was 25 credits, 25 credits may have to be risked for the re-roll), may be a fixed or predetermined amount, may be one of a number of predetermined amounts (which may depend on the number or type of cards held), or may be dynamically calculated based on the held cards and/or the possible outcomes from the re-rolling of the one or more dice. The dynamic calculation (and the one of multiple predefined amounts) embodiments may allow the amount of the side bet or wager to be based around the expected outcome value of taking the re-roll option. Thus, the higher the probability of improving your outcome award amount, the higher the side wager amount may be. Additionally, the dynamic calculation can provide a math neutral feature, or give an advantage to the house or player depending on how the bonus is implemented.

FIGS. 3A-3H and FIGS. 4A-4H are diagrams showing different game progression embodiments of a dice game having a re-roll feature. Both of these progressions utilize similar set ups of a dice bonus game using three dice having playing card symbols to form 3-card poker hands. Although these progressions could be implemented with any of the various features of other embodiments discussed above, these initial properties are set up to emphasize other features associated with these embodiments.

Figure 3A:
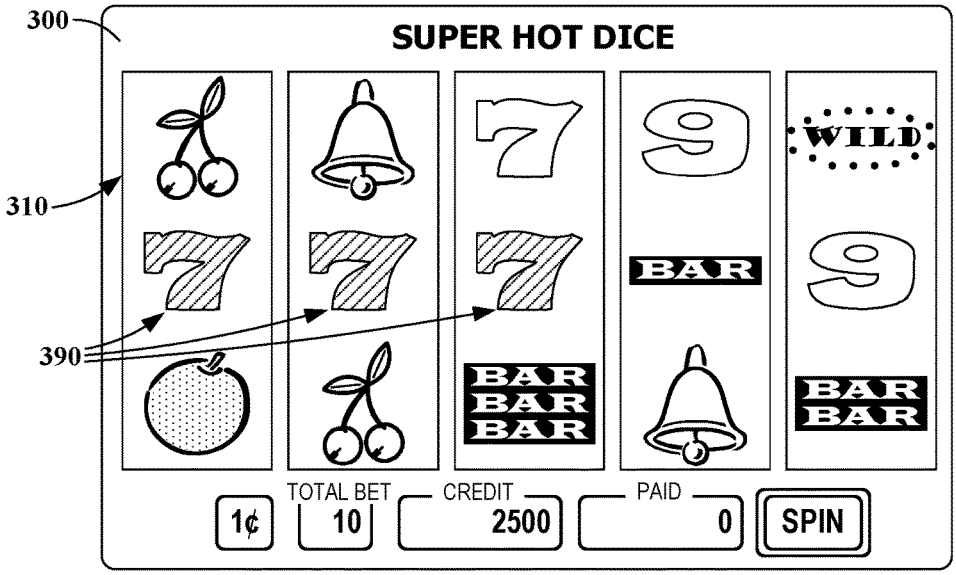
FIGS. 3A, 3B, 3C, 3D, 3E, 3F, 3G, and 3H are diagrams showing a game progression of a dice game having a re-roll feature according to embodiments of the invention.

Referring to FIGS. 3A-3H, a game display 300 is shown with a primary game play portion 310 showing a primary or base game that includes a video slot type game with five game reels each showing three symbols of game reels in an outcome grid. In other embodiments, any type of primary or base game may be used, or the following dice game may be used as the primary or base game. Referring to FIG. 3A, a symbol combination of 3 shaded "7s" 390 is received in the base game on the primary game play portion 310, which triggers the dice bonus game. As discusses herein, any number of different bonus triggers may be used to trigger a bonus gaming event using multi-positional game elements.

Figure 3B:
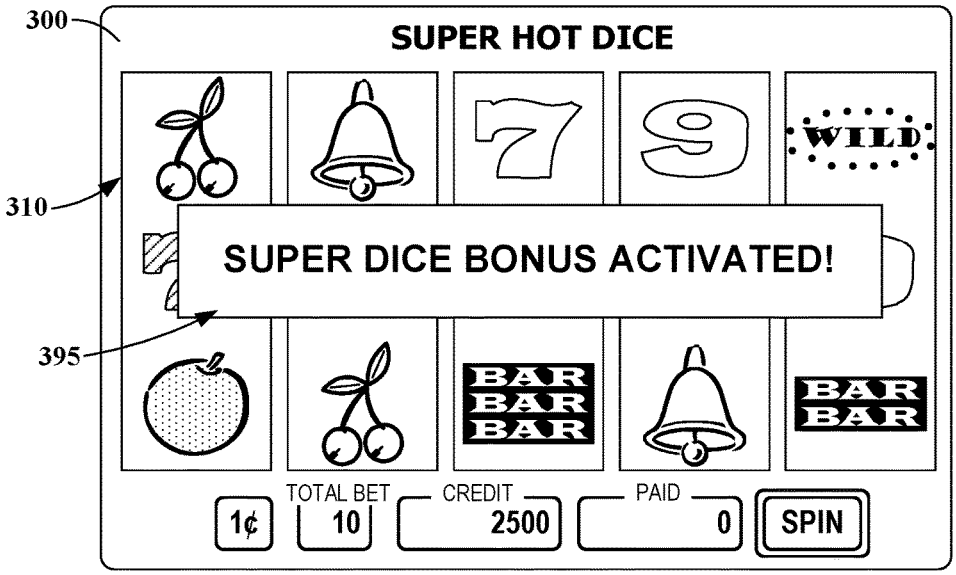
Figure 3C:
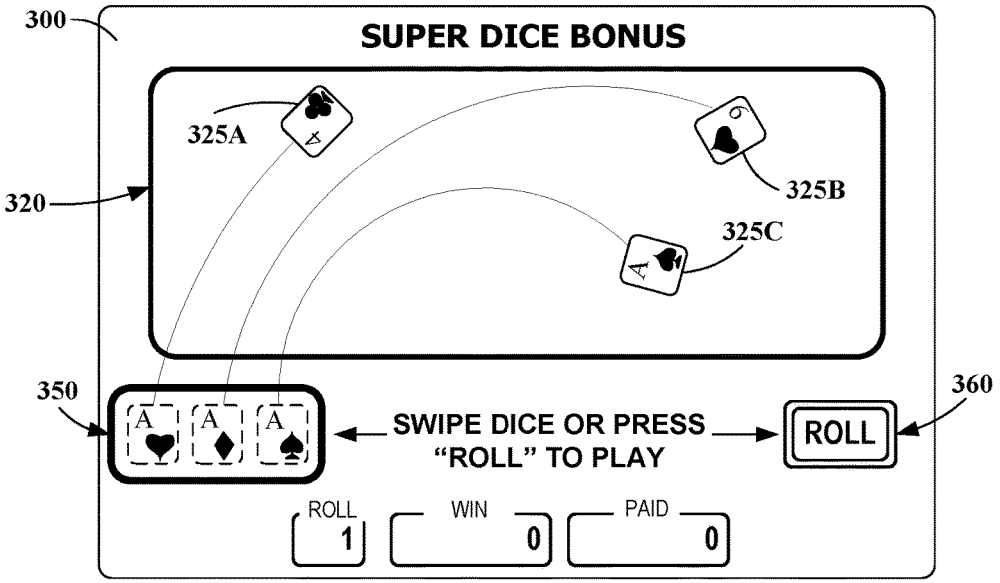

In FIG. 3B, a message 395 is displayed to inform the player that they have triggered or activated the Super Dice Bonus. Referring to FIG. 3C, a dice play portion 320 and dice starting portion 350 are shown on the display 300. The dice play portion 320 and dice starting portion 350 may replace the primary game play portion 310 on the display 300, or may be shown on a different portion of display 300. Here, the player may swipe their finger over the dice starting portion 350 to roll or activate the dice, or may push the touchscreen or physical "Roll" Button 360. As shown in FIG. 3C, dice 325A, 325B, and 325C are rolled into the dice play portion 320 and result in a 4C (4 of Clubs), 6H (6 of Hearts), and AS (Ace of Spades).

Figure 3D:
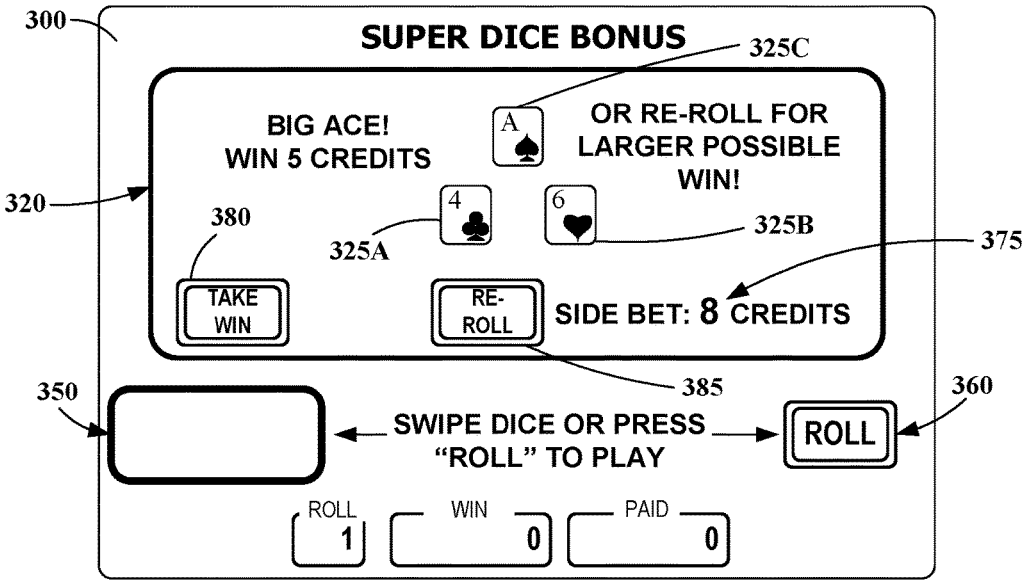

Referring to FIG. 3D, these dice outcomes 325A, 325B, and 325C are displayed and evaluated for possible awards and re-roll conditions. In this embodiment, the game rules specify that any Ace, pair of similarly ranked cards, or adjacently-ranked same suit cards satisfy a re-roll condition. Further, the rules specify that only one re-roll is allowed. However, any hand with a "9" high card or higher on one of the dice results in additional rolls of all of the dice. In other embodiments, as discussed above, other re-roll conditions may be used. As illustrated in FIG. 3D, since the Ace 323C meets the re-roll condition, it is separated from the other two dice 325A and 325B, an award amount just for the Ace is displayed (here, 5 credits), and the option to re-roll the other two dice are given. This option includes providing a "Take Win" button 380, a "Re-Roll" button 385 and an amount for a side bet or wager 375 needed for taking the re-roll option (here, 8 credits). The amount for a side bet or wager 375 may be a predefined amount, may be one of multiple possible predefined amounts depending on which type of hand satisfied the re-roll condition, or may be dynamically calculated based at least in part on the outcome of the initial hand.

Figure 3E:
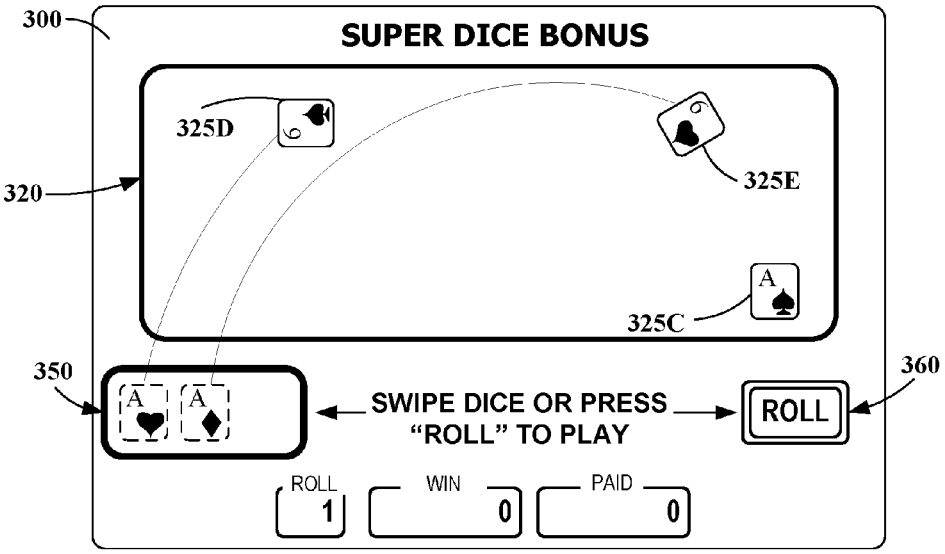

Here, the player must decide if they want to risk a side bet of 8 credits to improve their outcome. They have already secured a win of 5 credits with the Ace 325C and could simply take this win and move to the next roll by activating the "Take Win" button 380. Alternatively, the player may risk the 8 credit side wager to improve their hand by activating the "Re-Roll" button 385. As shown in FIG. 3E, the player chose to make the 8 credit side wager and re-roll the other two dice 325A and 325B. The results of this re-roll are shown as dice 325D and 325E, which land on a 6S (Six of Spades) and 6H (6 of Hearts). These dice may be transported back to the dice starting portion 350 for the re-roll or may be re-rolled within the dice play portion 320.

Figure 3F:
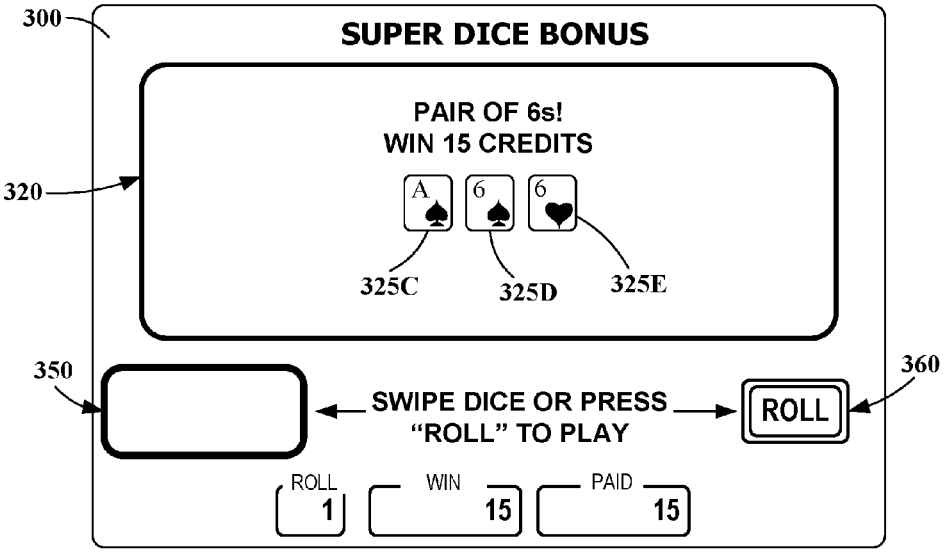
Figure 3G:
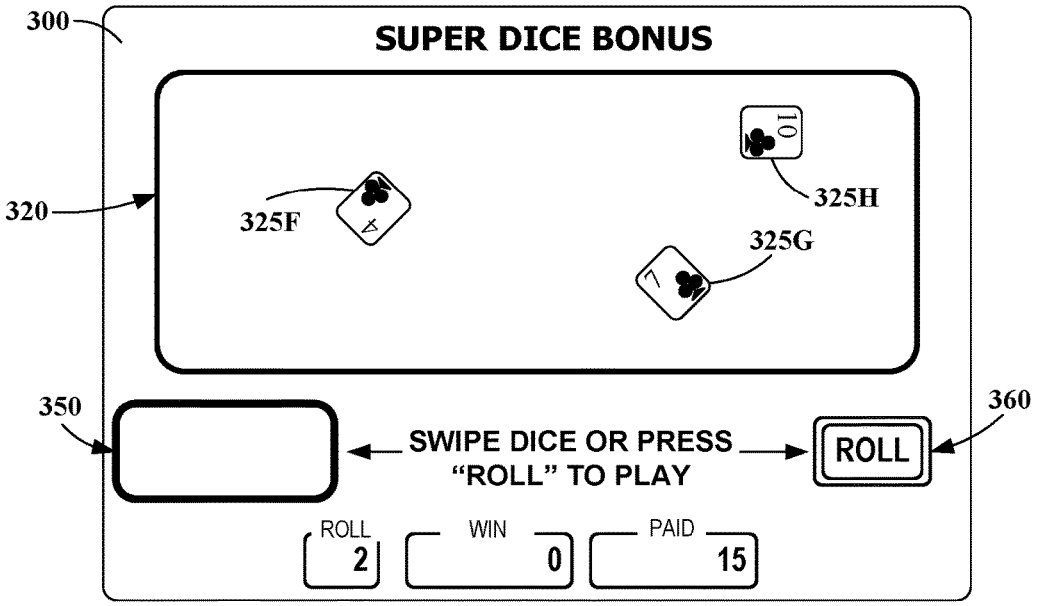

As shown in FIG. 3F, the final dice poker hand is displayed and evaluated. In this instance, the player has improved their hand with the re-roll by receiving a pair of "6s" on the re-rolled dice 325D and 325E, which has an associated award of 15 credits. Hence, the player risked 8 credits to improve their win from 5 credits to 15 credits. Thus, the re-roll decision paid off in this example. Since the player risked 8 credits, the 8 credits were deducted from the player credit meter (not shown). Additionally, as the player has a better than a "9" card high, the player moves to a second round of the bonus gaming event, which is shown in FIG. 3G. Note that in other embodiments the player may have been able to hold the pair of "6s" and tried to re-roll for the third "6" for another side wager. However, as the rules in this embodiment specified that only one re-roll was permitted per round, there was no option for another re-roll (see progression in FIGS. 4A-4H for this other type of embodiment).

Figure 3H:
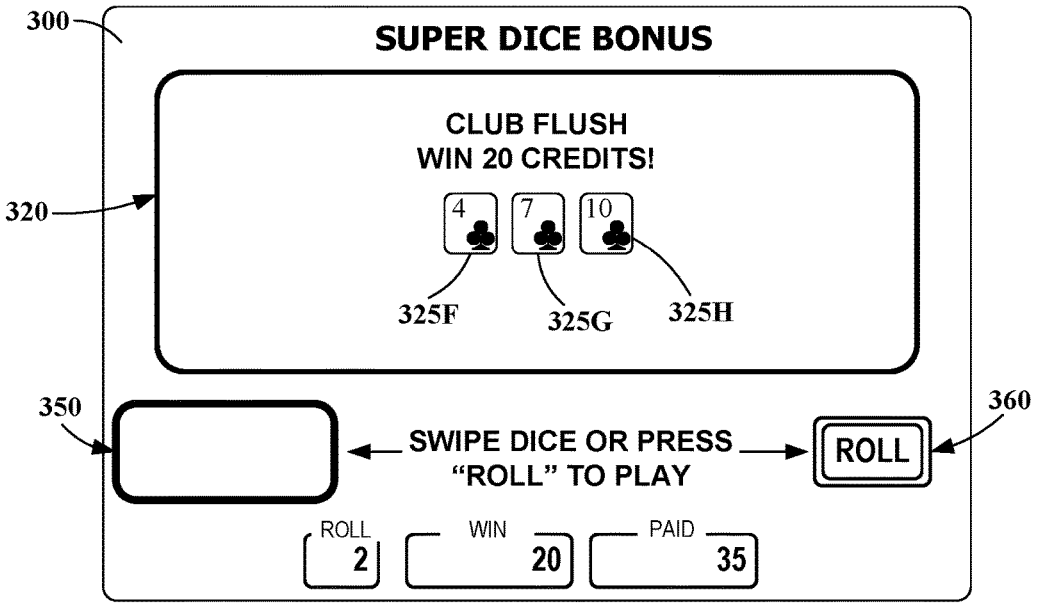

Referring to FIG. 3G, the player has rolled the dice 325F, 325G, and 325H and received a 4C (4 of Clubs), 7S (7 of Clubs), and 10C (10 of Clubs). As shown in FIG. 3H, this dice outcome 325F, 325G, and 325H results in a club flush with an associated award of 20 credits. Note that a re-roll condition was not satisfied with this roll, so a re-roll option is not presented to the player. If, however, the player had received a 5C (5 of Clubs) instead of the 7S, the player would have been presented with the option to re-roll the 10C to go for a straight flush with either a 3C (3 of Clubs) or 6C (6 of Clubs). To do this however, the player would not only be risking the side bet amount, but would be risking losing the club flush outcome. As this is not the case in FIG. 3H, however, the player is simply awarded the 20 credits and moves to the next round of the dice bonus game event since the flush is better than a "9" card high outcome. Additional rounds of this bonus game are not shown, but follow similar rules as have been described above.

Figure 4A:
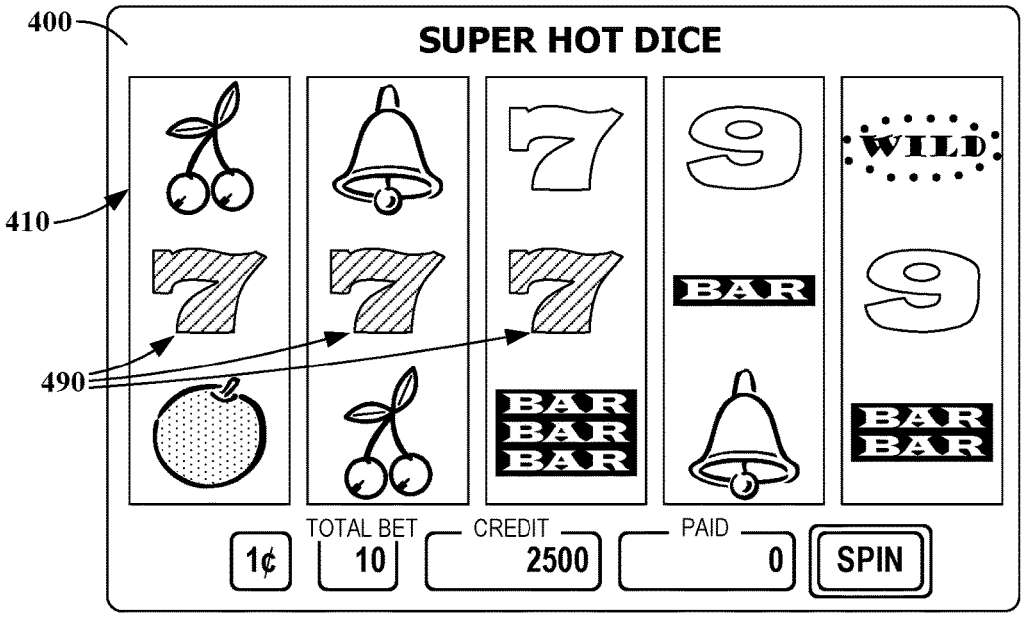
FIGS. 4A, 4B, 4C, 4D, 4E, 4F, 4G, and 4H are diagrams showing another game progression of a dice game having a re-roll feature according to embodiments of the invention.

Referring to FIGS. 4A-4H, a game display 400 is shown with a primary game play portion 410 showing a primary or base game that includes a video slot type game with five game reels each showing three symbols of game reels in an outcome grid. In other embodiments, any type of primary or base game may be used, or the following dice game may be used as the primary or base game. Referring to FIG. 4A, a symbol combination of 3 shaded "7s" 490 is received in the base game on the primary game play portion 410, which triggers the dice bonus game. As discusses herein, any number of different bonus triggers may be used to trigger a bonus gaming event using multi-positional game elements.

Figure 4B:
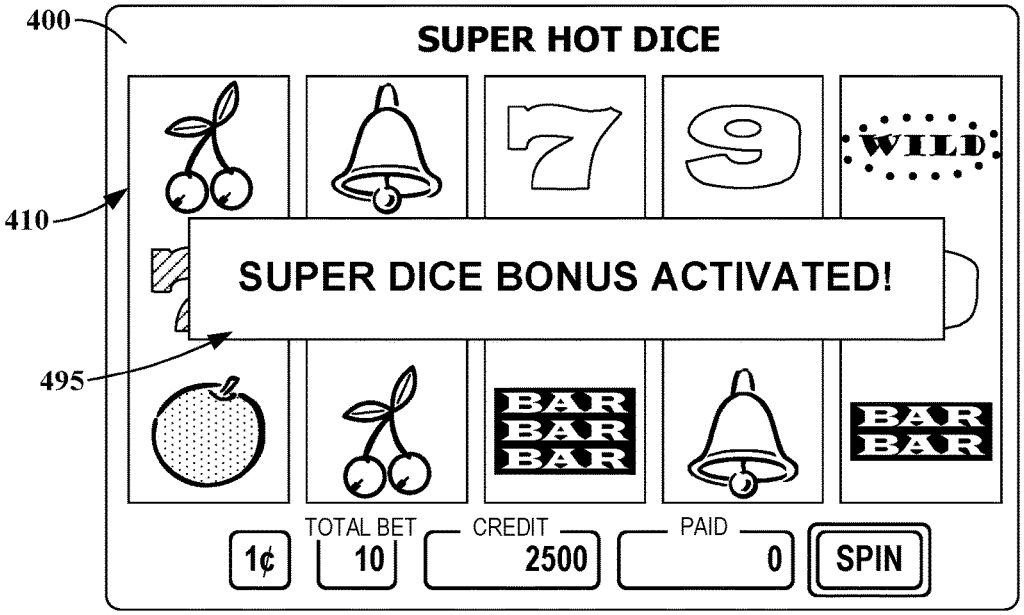
Figure 4C:
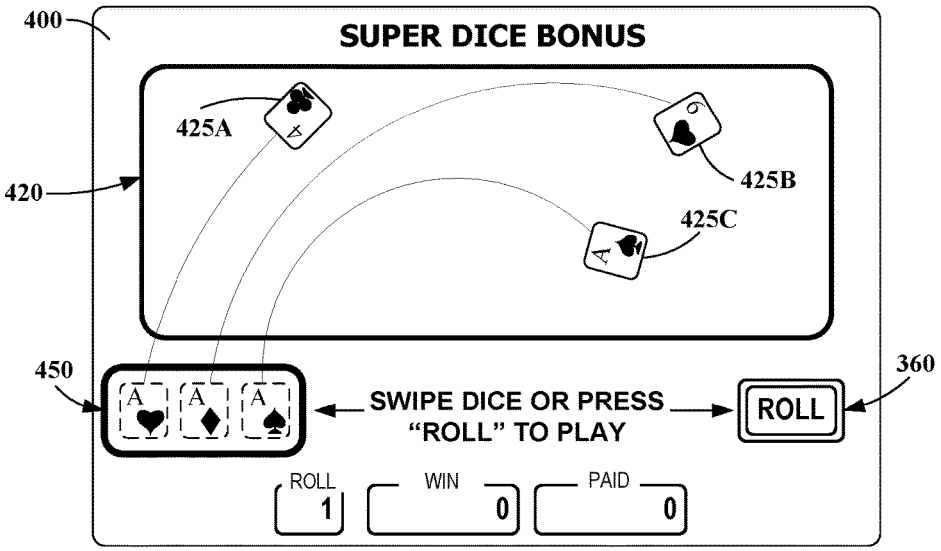

In FIG. 4B, a message 495 is displayed to inform the player that they have triggered or activated the Super Dice Bonus. Referring to FIG. 4C, a dice play portion 420 and dice starting portion 450 are shown on the display 400. The dice play portion 420 and dice starting portion 450 may replace the primary game play portion 410 on the display 400, or may be shown on a different portion of display 400. Here, the player may swipe their finger over the dice starting portion 450 to roll or activate the dice, or may push the touchscreen or physical "Roll" Button 460. As shown in FIG. 4C, dice 425A, 425B, and 425C are rolled into the dice play portion 420 and result in a 4C (4 of Clubs), 6H (6 of Hearts), and AS (Ace of Spades).

Figure 4D:
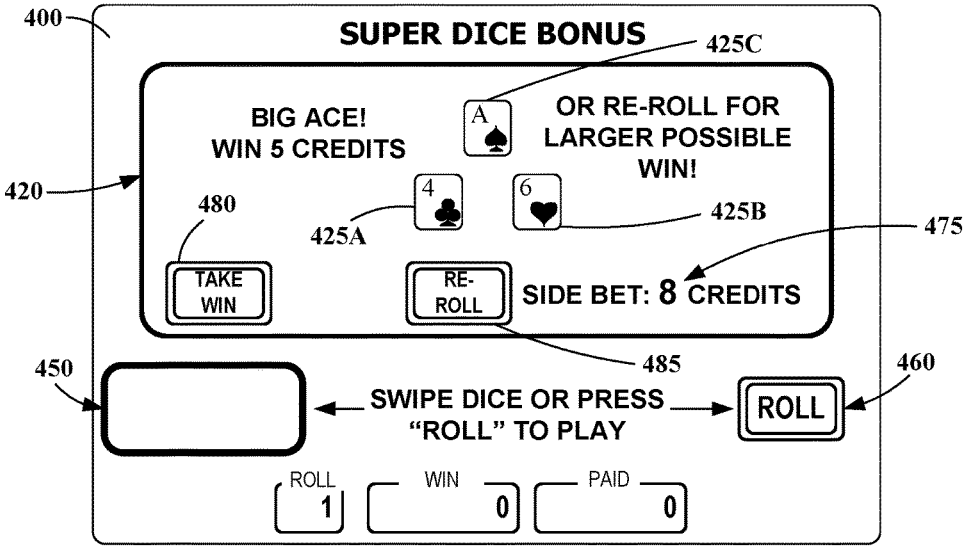

Referring to FIG. 4D, these dice outcomes 425A, 425B, and 425C are displayed and evaluated for possible awards and re-roll conditions. In this embodiment, the game rules specify that any Ace, pair of similarly ranked cards, or adjacently-ranked same suit cards satisfy a re-roll condition. Further, the rules specify that as long as a better hand can be held from the re-roll, another re-roll option is provided. Additionally, any hand with a "9" high card or higher on one of the dice results in additional rolls of all of the dice. In other embodiments, as discussed above, other re-roll conditions may be used. As illustrated in FIG. 4D, since the Ace 423C meets the re-roll condition, it is separated from the other two dice 425A and 425B, an award amount just for the Ace is displayed (here, 5 credits), and the option to re-roll the other two dice are given. This option includes providing a "Take Win" button 480, a "Re-Roll" button 485 and an amount for a side bet or wager 475 needed for taking the re-roll option (here, 8 credits). The amount for a side bet or wager 475 may be a predefined amount, may be one of multiple possible predefined amounts depending on which type of hand satisfied the re-roll condition, or may be dynamically calculated based at least in part on the outcome of the initial hand.

Figure 4E:
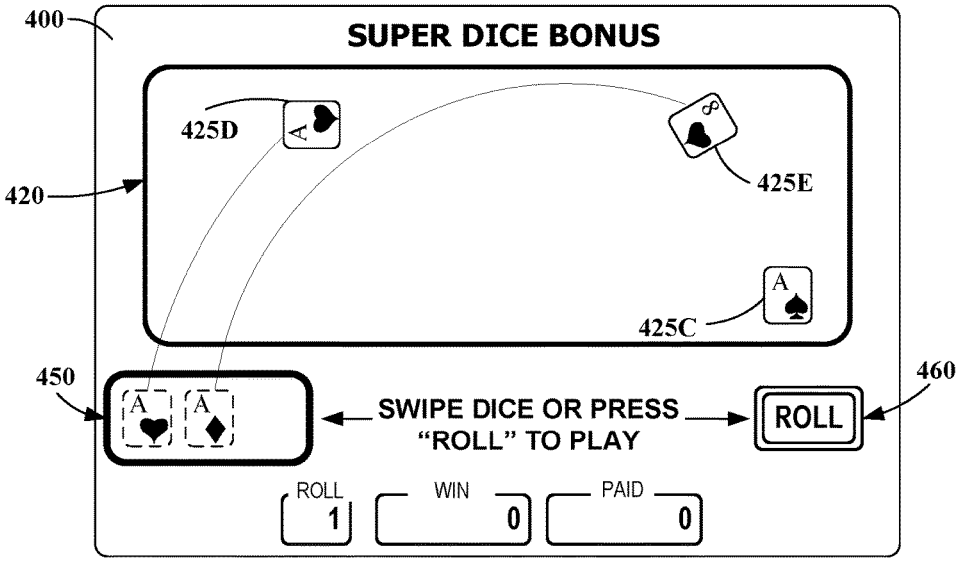

Here, the player must decide if they want to risk a side bet of 8 credits to improve their outcome. They have already secured a win of 5 credits with the Ace 425C and could simply take this win and move to the next roll by activating the "Take Win" button 480. Alternatively, the player may risk the 8 credit side wager to improve their hand by activating the "Re-Roll" button 485. As shown in FIG. 4E, the player chose to make the 8 credit side wager and re-roll the other two dice 425A and 425B. The results of this re-roll are shown as dice 425D and 425E, which land on a AH (Ace of Hearts) and 8H (8 of Hearts). These dice may be transported back to the dice starting portion 450 for the re-roll or may be re-rolled within the dice play portion 420.

Figure 4F:
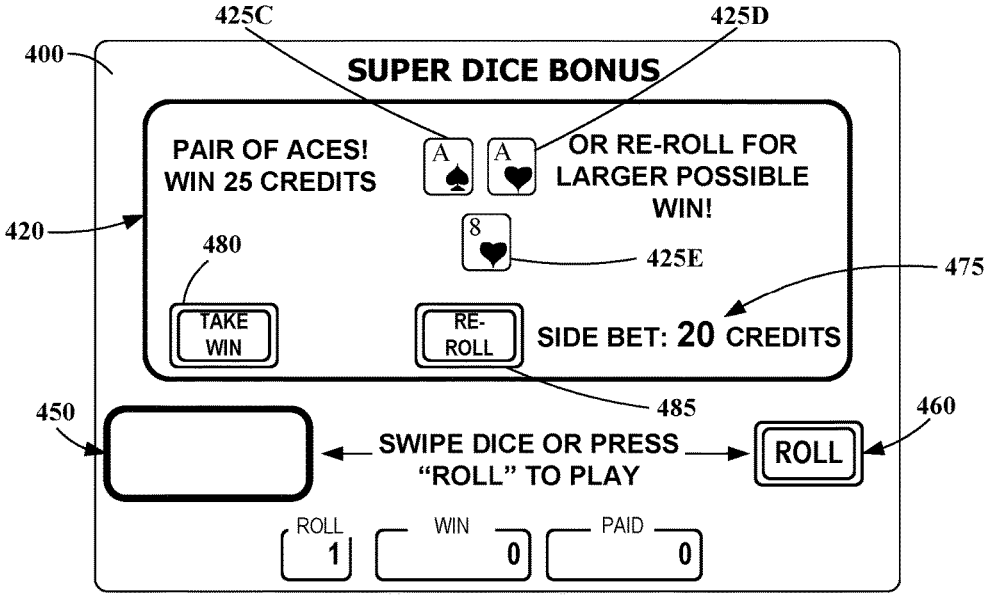

As shown in FIG. 4F, the final dice poker hand is displayed and evaluated. In this instance, the player has improved their hand with the re-roll by receiving another Ace 425D on the re-roll, which gives the player a pair of Aces with the held die 425C, which has an associated award of 20 credits. Hence, the player risked 8 credits to improve their win from 5 credits to 25 credits. Thus, the re-roll decision paid off in this example. Since the player risked 8 credits, the 8 credits were deducted from the player credit meter (not shown). Additionally, as the player has met the re-roll condition again with a better hand to hold (pair of Aces instead of a single Ace), the player is provided with another opportunity to re-roll the other die 425E. This time, however, the risk for re-rolling the remaining die 425E to go for the 3-of-a-kind of Aces has a side bet or wager amount 475 of 20 credits. Again this side bet amount may be predetermined, one of multiple predetermined values, or dynamically calculated based on the existing outcome and probability of improving that outcome.

Figure 4G:
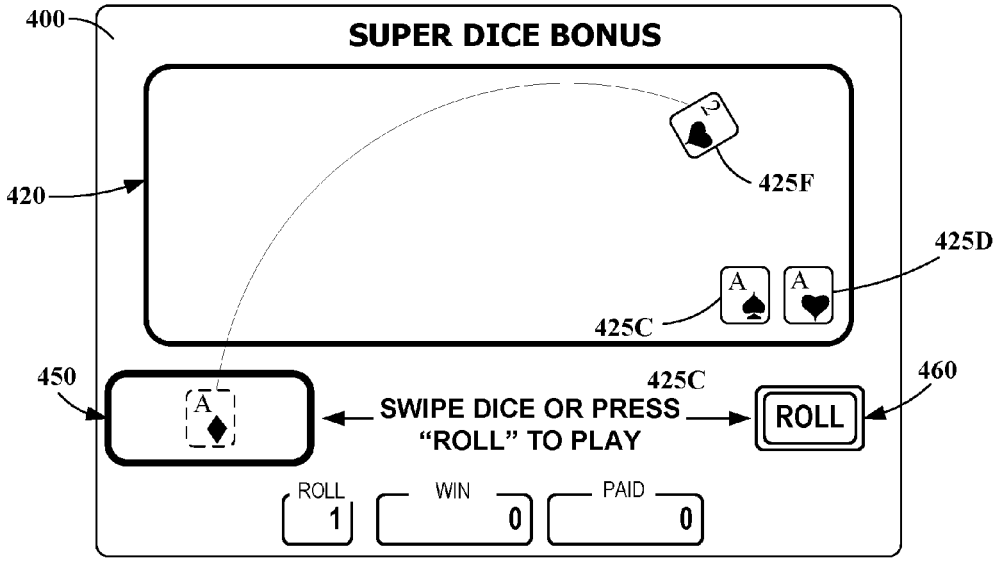
Figure 4H:
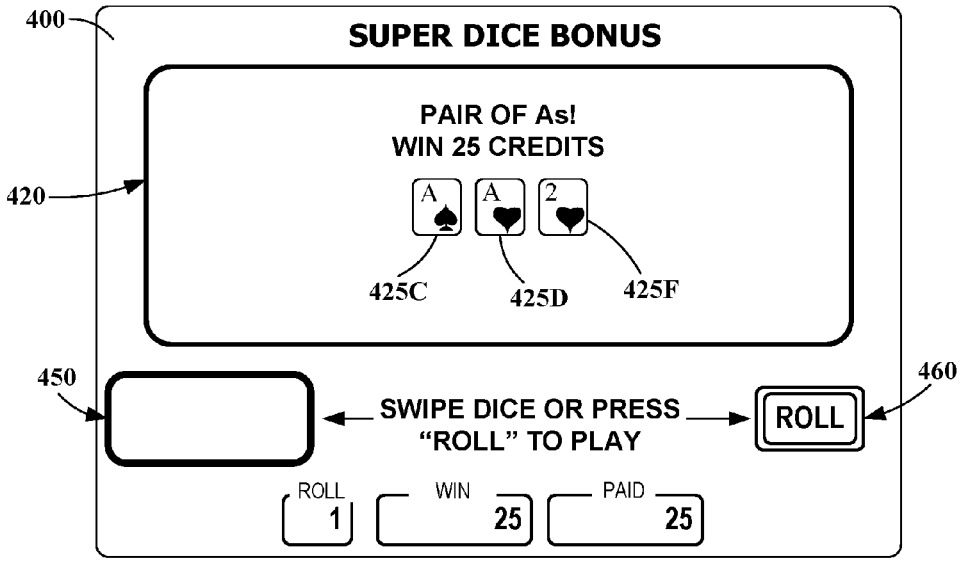

As shown in FIG. 4G, the player has taken the side bet and has re-rolled the remaining die 425E, which results in die 425F with a result of 2H (2 of Hearts). Thus, the player did not improve their hand again. The player, however, is still awarded the 25 credits from the pair of Aces as shown in FIG. 4H. Additionally, as the player has a better than a "9" card high, the player moves to a second round of the bonus gaming event, which is not shown.

Figure 5:
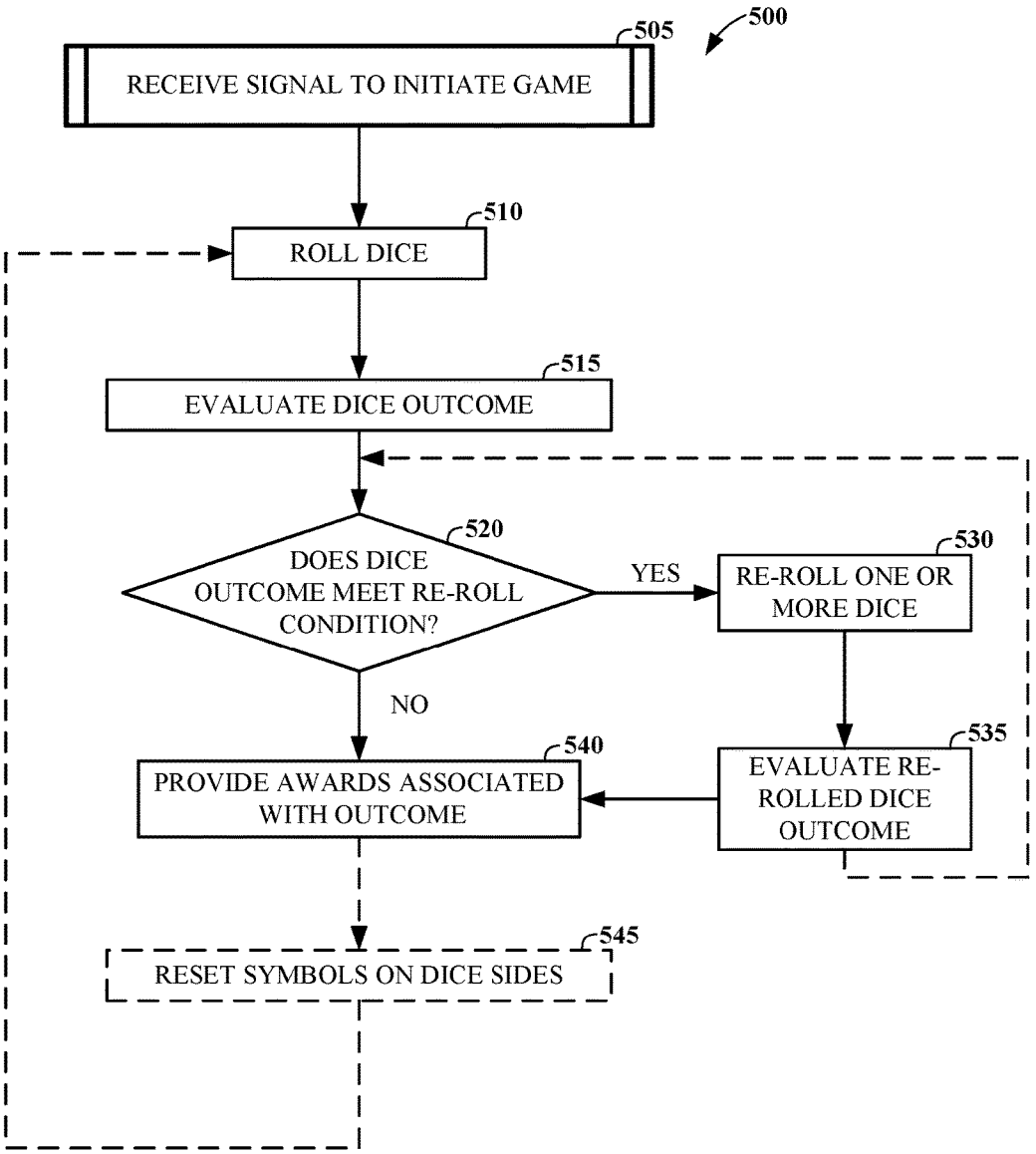
FIG. 5 is a flow diagram illustrating a method of implementing a dice game having a re-roll feature according to embodiments of the invention.
Figure 6:
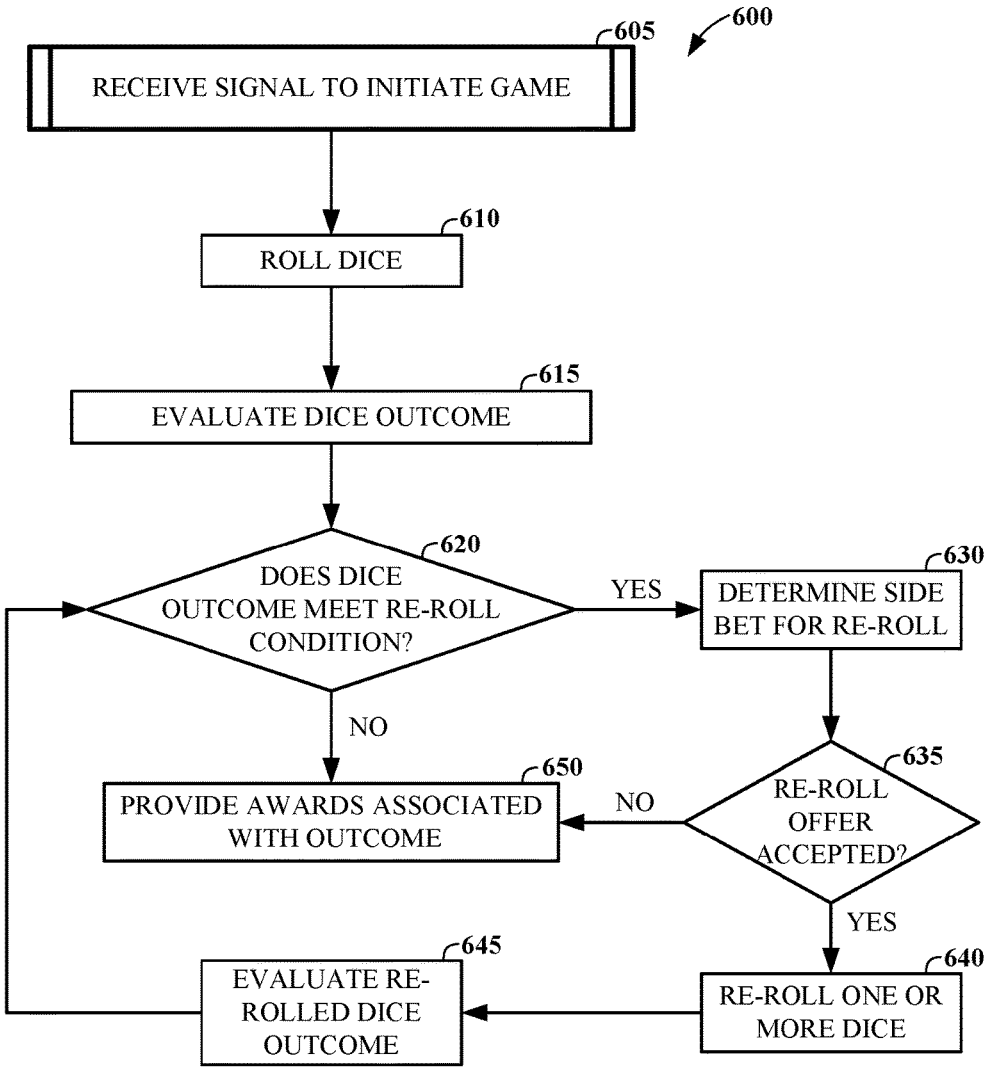
FIG. 6 is a flow diagram illustrating another method of implementing a dice game having a re-roll feature according to embodiments of the invention.

FIGS. 5 and 6 are flow diagrams representing methods in which a gaming device and/or gaming system can be operated according to embodiments of the invention. Although various processes are shown in a particular order in these flow diagrams, the order of these processes can be changed in other embodiments without deviating from the scope or spirit of this concept. Hence, the order of the processes shown is for illustrative purposes only and is not meant to be restrictive. Additional game processes may also be included between various processes even though they are not shown in these flow diagrams for clarity purposes. Further each of the processes may be performed by components in a single game device, such as by a game processor, or may be performed in part or whole by a remote server or processor connected to the gaming device via a network. Each process may be encoded in instructions that are stored in a memory, a computer-readable medium, or another type of storage device. Note that these example methods are just some embodiments of how the steps of a game operation can be implemented. As discussed and shown above, many variations exist which may require additional, fewer, or different processes to complete.

Referring to FIG. 5, flow 500 begins at process 505 where a signal is received to initiate a gaming event. The gaming event may be a primary or base game, where an initiation signal may be, for example, received in response to a wager being placed and a spin button being depressed. Alternatively, the gaming event may be a bonus game, where an initiation signal is received in response to a bonus trigger such as the occurrence of a game outcome in a primary game or a mystery bonus trigger. In response to the received signal in process 505, flow 500 proceeds to process 510 where dice are rolled. Although dice are used in this exemplary embodiment, any multi-positional game elements may be used in other embodiments. The outcome of the dice roll is evaluated in process 515 and a determination is made in process 520 as to whether the dice outcome meets a re-roll condition.

As described above, a re-roll condition may be defined in a variety of manners depending on the object and game play design of the game. For example, a certain outcome on one or more of the dice may be needed to satisfy the re-roll condition, or the re-roll condition may be based on matching or similar outcomes on the dice. If the dice outcome does satisfy or meet the re-roll condition, flow 500 proceeds to process 530 where one or more of the dice are re-rolled. The selection of which of the dice to re-roll in process 530 is dependent on the rules of the game event. For example, in embodiments where one or more dice need a certain outcome to meet the re-roll condition, the die or dice meeting those conditions may be maintained while the remaining die or dice are re-rolled. In another example, all of the dice may be re-rolled in the original roll of the dice does not meet a minimum paying combination in a paytable.

After the dice are re-rolled in process 530, flow 500 proceeds to process 535 where the re-rolled dice outcome is evaluated. Here, all of the dice, including any held or maintained dice from the original outcome, may be evaluated together, or only the re-rolled dice may be evaluated. As shown by the dashed arrow, in one optional embodiment, flow 500 returns to process 520 to determine if the dice meet another re-roll condition. In these embodiments, a recursive process may be used with multiple re-rolls possible to continue improving dice outcomes, or otherwise changing one or more of the dice positions. In one example where 5 dice are rolled and landing a "6" on one or more of the dice satisfies a re-rolling condition, a first roll may result in the outcomes 4; 1; 4; 6; and 3. The die with the 6 may be held and the other four dice may be re-rolled since the one 6 triggers a re-roll condition. In the second round, the four re-rolled dice have the results: 6; 5; 6; and 4. Here, the two 6s may be held along with the original "6" from the first stage of the game event, while the remaining two dice are re-rolled. Again, because a 6 is received in the second stage, a re-roll condition is met. The second re-roll results in a 5 and 3. Here, since a 6 is not received, a re-roll condition is not met and the final dice hand of 6, 6, 6, 5, and 3 is used to evaluate the game event for awards.

Although the above example uses standard dice with one to six pips on each side, any type of symbols may be used on the dice, such as slot symbols, playing card ranks and suits, or any other type of symbol. Additionally, the dice may have more or fewer than six sides, or any type of multi-positional game elements may be used.

Returning to flow 500, when the dice outcome does not meet a re-roll condition in process 520, or where game rules provide for a set number of re-rolls (such as one, two, or more) that have elapsed after the evaluation in process 535, awards associated with the outcome are provided in process 540. Awards may be given by comparing the final dice outcome to a paytable or other award schedule. In other embodiments, awards may be given for each dice hand rolled, including a beginning role and any intermediary rolls prior to a re-roll of some or all of the dice. These multiple awards may then be aggregated as part of process 540.

In some embodiments, the method represented by flow 500 ends after awards are provided in process 540. In other embodiments, however, flow 500 optionally continues the game event by returning to process 510 to roll the dice again. These embodiments may be representative of embodiments where multiple rolls are given for the dice, or in embodiments where a minimum final outcome or condition results in the game event continuing (as shown in the incorporated '473 application). In some of these embodiments, optional process 545 may be implemented to reset the symbols on the dice sides prior to rolling the dice again in process 510.

Referring to FIG. 6, flow 600 begins at process 605 where a signal is received to initiate a gaming event. As with process 505 described above, the gaming event may be a primary or base game, where an initiation signal may be, for example, received in response to a wager being placed and a spin button being depressed. Alternatively, the gaming event may be a bonus game, where an initiation signal is received in response to a bonus trigger such as the occurrence of a game outcome in a primary game or a mystery bonus trigger. In response to the received signal in process 605, flow 600 proceeds to process 610 where dice are rolled. Although dice are used in this exemplary embodiment, any multi-positional game elements may be used in other embodiments. The outcome of the dice roll is evaluated in process 615 and a determination is made in process 620 as to whether the dice outcome meets a re-roll condition.

As described above, a re-roll condition may be defined in a variety of manners depending on the object and game play design of the game. For example, a certain outcome on one or more of the dice may be needed to satisfy the re-roll condition, or the re-roll condition may be based on matching or similar outcomes on the dice. If the dice outcome does satisfy or meet the re-roll condition, flow 600 proceeds to process 630 where a side bet or wager is determined for the re-roll. The determined side bet or wager may be predefined amount or determined to be one of multiple possible predefined amounts, or may be dynamically calculated based on the expected outcome value or advantage a re-roll would provide. For example, in a poker dice embodiment where each of three dice has playing cards on each side, an outcome where a pair of similar ranked cards are received may satisfy a re-roll condition with the possibility to re-roll the third dice for a three-of-a-kind. The award for a three-of-a-kind outcome may be twelve times that of an outcome of a pair. The matching third card may only be on one of the six sides of the third dice. Thus, the player has a 1 in 6 chance of re-rolling the third dice to complete the three-of-a-kind outcome. Hence, the expected outcome value would be the 12× award value multiplied by the 1/6 chance of receiving the desired outcome, or an expected outcome value of 2. To keep the expected value math neutral for this feature, a dynamically calculated side bet or wager in process 630 may be 2× the amount of the original wager. Alternatively, the amount of the side wager may be set at over 2× the amount of the original wager to maintain a house edge, or may be set at under 2× the amount of the original wager to encourage a player to use the option.

In process 635 it is determined if the re-roll side bet offer is accepted. If the offer is accepted, flow 600 proceeds to process 640 where the side wager amount is deducted from a win amount on a win meter or player credit amount on a credit meter, and one or more of the dice are re-rolled. This re-roll process 640 may include any of the variations discussed above. Flow 600 then proceeds to process 645 where the dice outcome after the re-roll is evaluated. Here, the entire outcome including any held dice and the re-rolled dice may be evaluated together, only the re-rolled dice may be evaluated, or only any held dice may be evaluated. Flow 620 then returns to process 620 to determine if the dice outcome satisfies a re-roll condition. If the dice outcome does not satisfy the re-roll condition in process 620, or if the re-roll offer is not accepted in process 635, flow 600 proceeds to process 650 where any awards associated with the dice outcome are provided. As mentioned above, in some embodiments, each dice outcome including an initial dice outcome and dice outcomes generated by intermediary re-rolls may be evaluated for awards, which are aggregated and provided in process 650. Alternatively, only a final dice outcome may be evaluated for awards in process 650.

Figure 7:
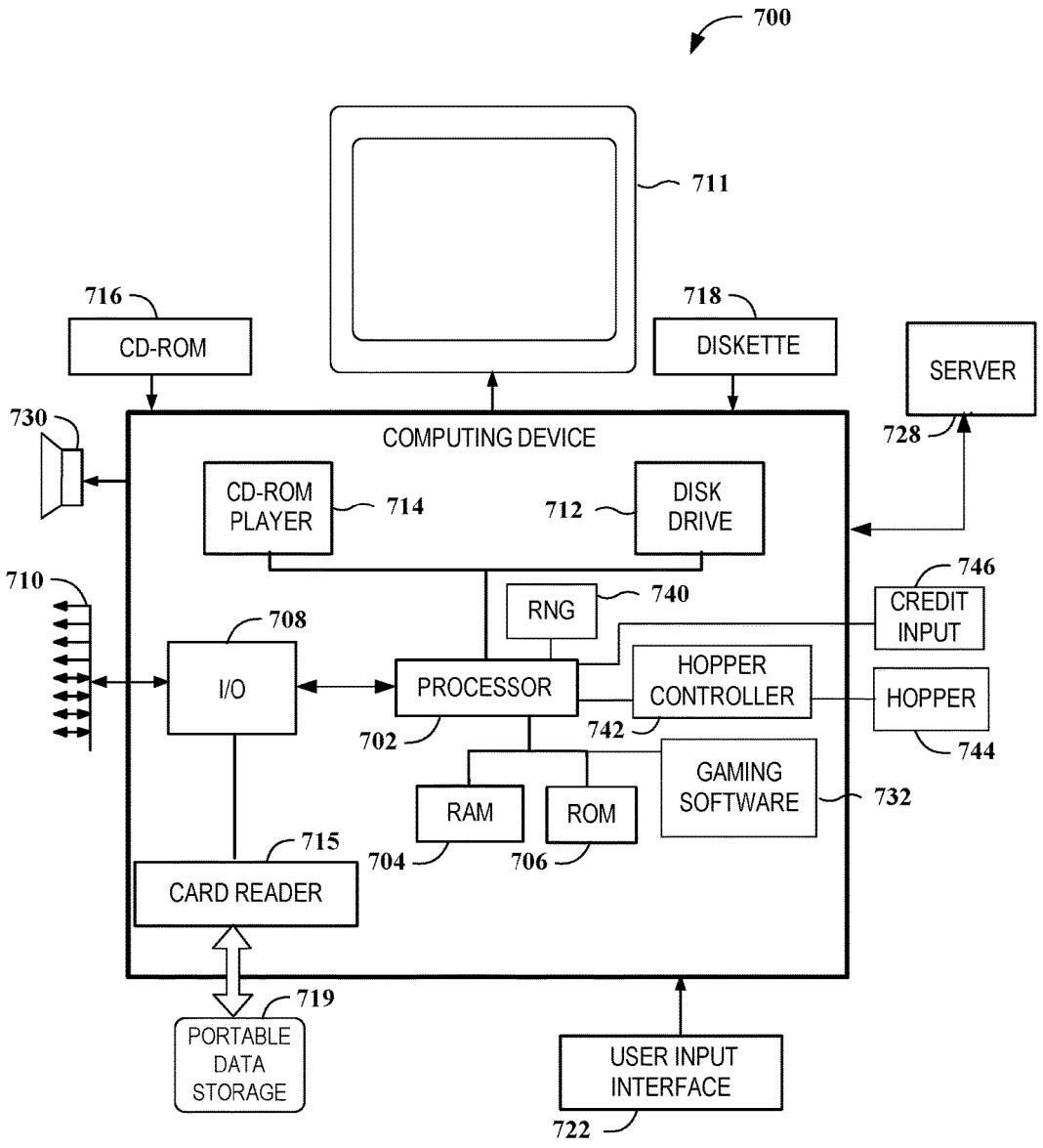
FIG. 7 is a block diagram illustrating a computing arrangement according to embodiments of the invention.

As may now be readily understood, one or more devices may be programmed to play various embodiments of the invention. The present invention may be implemented as a casino gaming machine or other special purpose gaming kiosk as described hereinabove, or may be implemented via computing systems operating under the direction of local gaming software, and/or remotely-provided software such as provided by an application service provider (ASP). The casino gaming machines utilize computing systems to control and manage the gaming activity. An example of a representative computing system capable of carrying out operations in accordance with the invention is illustrated in FIG. 7.

Hardware, firmware, software or a combination thereof may be used to perform the various gaming functions, display presentations and operations described herein. The functional modules used in connection with the invention may reside in a gaming machine as described, or may alternatively reside on a stand-alone or networked computer. The computing structure 700 of FIG. 7 is an example computing structure that can be used in connection with such electronic gaming machines, computers, or other computer-implemented devices to carry out operations of the present invention.

The example computing arrangement 700 suitable for performing the gaming functions in accordance with the present invention typically includes a central processor (CPU) 702 coupled to random access memory (RAM) 704 and some variation of read-only memory (ROM) 706. The ROM 706 may also represent other types of storage media to store programs, such as programmable ROM (PROM), erasable PROM (EPROM), etc. The processor 702 may communicate with other internal and external components through input/output (I/O) circuitry 708 and bussing 710, to provide control signals, communication signals, and the like.

The computing arrangement 700 may also include one or more data storage devices, including hard and floppy disk drives 712, CD-ROM drives 714, card reader 715, and other hardware capable of reading and/or storing information such as DVD, etc. In one embodiment, software for carrying out the operations in accordance with the present invention may be stored and distributed on a CD-ROM 716, diskette 718, access card 719, or other form of computer readable media capable of portably storing information. These storage media may be inserted into, and read by, devices such as the CD-ROM drive 714, the disk drive 712, card reader 715, etc. The software may also be transmitted to the computing arrangement 700 via data signals, such as being downloaded electronically via a network, such as the Internet. Further, as previously described, the software for carrying out the functions associated with the present invention may alternatively be stored in internal memory/storage of the computing device 700, such as in the ROM 706.

The computing arrangement 700 is coupled to the display 711, which represents a display on which the gaming activities in accordance with the invention are presented. The display 711 represents the "presentation" of the video information in accordance with the invention, and may be any type of known display or presentation screen, such as liquid crystal displays, plasma displays, cathode ray tubes (CRT), digital light processing (DLP) displays, liquid crystal on silicon (LCOS) displays, etc.

Where the computing device 700 represents a stand-alone or networked computer, the display 711 may represent a standard computer terminal or display capable of displaying multiple windows, frames, etc. Where the computing device is embedded within an electronic gaming machine, the display 711 corresponds to the display screen of the gaming machine/kiosk. A user input interface 722 such as a mouse, keyboard/keypad, microphone, touch pad, trackball, joystick, touch screen, voice-recognition system, etc. may be provided. The display 711 may also act as a user input device, e.g., where the display 711 is a touchscreen device. In embodiments, where the computing device 700 is implemented in a personal computer, tablet, smart phone, or other consumer electronic device, the user interface and display may be the available input/output mechanisms related to those devices.

Chance-based gaming systems such as slot machines, in which the present invention is applicable, are governed by random numbers and processors, as facilitated by a random number generator (RNG). The fixed and dynamic symbols generated as part of a gaming activity may be produced using one or more RNGs. RNGs as known in the art may be implemented using hardware, software operable in connection with the processor 702, or some combination of hardware and software. The present invention is operable using any known RNG, and may be integrally programmed as part of the processor 702 operation, or alternatively may be a separate RNG controller 740.

The computing arrangement 700 may be connected to other computing devices or gaming machines, such as via a network. The computing arrangement 700 may be connected to a network server 728 in an intranet or local network configuration. The computer may further be part of a larger network configuration as in a global area network (GAN) such as the Internet. In such a case, the computer may have access to one or more web servers via the Internet. In other arrangements, the computing arrangement 700 may be configured as an Internet server and software for carrying out the operations in accordance with the present invention may interact with the player via one or more networks. The computing arrangement 700 may also be operable over a social network or other network environment that may or may not regulate the wagering and/or gaming activity associated with gaming events played on the computing arrangement.

Other components directed to gaming machine implementations include manners of gaming participant payment, and gaming machine payout. For example, a gaming machine including the computing arrangement 700 may also include a hopper controller 742 to determine the amount of payout to be provided to the participant. The hopper controller may be integrally implemented with the processor 702, or alternatively as a separate hopper controller 742. A hopper 744 may also be provided in gaming machine embodiments, where the hopper serves as the mechanism holding the coins/tokens of the machine. The wager input module 746 represents any mechanism for accepting coins, tokens, coupons, bills, electronic fund transfer (EFT), tickets, credit cards, smart cards, membership/loyalty cards, etc., for which a participant inputs a wager amount. It will be appreciated that the primary gaming software 732 may be able to control payouts via the hopper 744 and controller 742 for independently determined payout events.

Among other functions, the computing arrangement 700 provides an interactive experience to players via input interface 722 and output devices, such as the display 711, speaker 730, etc. These experiences are generally controlled by gaming software 732 that controls a primary gaming activity of the computing arrangement 700. The gaming software 732 may be temporarily loaded into RAM 704, and may be stored locally using any combination of ROM 706, drives 712, media player 714, or other computer-readable storage media known in the art. The primary gaming software 732 may also be accessed remotely, such as via the server 728 or the Internet.

The primary gaming software 732 in the computing arrangement 700 is shown here as an application software module. According to embodiments of the present invention, this software 732 provides a slot game or similar game of chance as described hereinabove. For example, the software 732 may present, by way of the display 711, representations of symbols to map or otherwise display as part of a slot based game having reels. However, in other embodiments, the principles of this concept may be applied to poker games or other types of games of chance. One or more aligned positions of these game elements may be evaluated to determine awards based on a paytable. The software 732 may include instructions to provide other functionality as known in the art and described herein, such as shown and described above regarding FIGS. 1-6.

The foregoing description of the exemplary embodiments has been presented for the purposes of illustration and description. It is not intended to be exhaustive or to limit the invention to the precise form disclosed. Many modifications and variations are possible in light of the above teaching. For example, the present invention is equally applicable in electronic or mechanical gaming machines, and is also applicable to live table versions of gaming activities that are capable of being played in a table version (e.g., machines involving poker or card games that could be played via table games).

Some embodiments of the invention have been described above, and in addition, some specific details are shown for purposes of illustrating the inventive principles. However, numerous other arrangements may be devised in accordance with the inventive principles of this patent disclosure. Further, well known processes have not been described in detail in order not to obscure the invention. Thus, while the invention is described in conjunction with the specific embodiments illustrated in the drawings, it is not limited to these embodiments or drawings. Rather, the invention is intended to cover alternatives, modifications, and equivalents that come within the scope and spirit of the inventive principles set out in the appended claims.

The invention claimed is:

1. A gaming device comprising:

a game display for displaying game events;

a wager input device structured to receive physical items associated with a currency value;

a memory configured to store a credit value;

a player interface device for receiving inputs related to the game events; and a processor operable to:

receive a signal indicating that a physical item associated with a currency value has been received by the wager input device;

increase the credit amount stored in the memory based on the currency value of the received physical item;

provide a first game element having a plurality of positions;

provide a second game element having a plurality of positions;

select symbols from a plurality of eligible symbols to map to the positions of the first game element and the positions of the second game element;

randomize the first game element and the second game element to display at least one position of the first game element and display at least one position of the second game element to form a first event outcome;

evaluate the one or more symbols associated with the displayed positions of the first game element and the second game element in the first event outcome;

re-randomize the second game element to display at least one position of the second game element to form, along with the at least one position of the first game element from the first event outcome, a second event outcome when the first event outcome satisfies a predefined condition; and evaluate the one or more symbols respectively associated with the displayed positions of the first game element and the second game element in the second event outcome to determine awards.

2. The gaming device of claim 1, wherein the plurality of eligible symbols each include a representation of a virtual playing card from a deck of virtual playing cards.

3. The gaming device of claim 2, wherein evaluating the one or more symbols associated with the displayed positions of the first game element and the second game element in the first event outcome includes determining if the displayed playing cards on the first game element and the second game element form a poker hand that satisfies a minimum poker threshold according to a predefined poker paytable.

4. The gaming device of claim 3, wherein the first game element and second game element are six-sided dice, where each side of the dice is configured to display one card selected from the deck of cards.

5. The gaming device of claim 4, wherein selecting symbols from a plurality of eligible symbols to map to the positions of the first game element and the positions of the second game element includes randomly selecting twelve cards from the deck of cards, each of the randomly-selected cards being mapped to one of the positions on either the first game element or the second game element.

6. The gaming device of claim 1, wherein the plurality of eligible symbols includes slot symbols associated with a game of chance using spinning reels.

7. The gaming device of claim 1, wherein the plurality of eligible symbols includes multiplier values.

8. The gaming device of claim 1, wherein the plurality of eligible symbols includes credit values.

9. The gaming device of claim 1, wherein prior to re-randomizing the second game element, the processor is further operable to select new symbols from the plurality of symbols to map the positions of the second game element.

10. A method of operating a gaming device having a game display, a wager input device structured to receive physical items associated with a currency value, a memory configured to store a credit amount, a game processor, and a player input device, the method comprising:

receiving a signal indicating that a physical item associated with a currency value has been received by the wager input device;

increasing the credit amount stored in the memory based on the currency value of the received physical item;

receiving a signal to initiate a first game event on the gaming device;

providing a plurality of multi-positional game elements;

selecting a number of cards in a deck of cards for use in the first game event, the number of selected cards corresponding to a total number of positions in the plurality of multi-positional game elements;

assigning each selected card to one of the positions of the multi-positional game elements so that each position of each multi-positional game element is associated with a card;

randomizing the multi-positional game elements to display a position of each of the multi-positional game elements on the game display;

evaluating an initial poker hand created by the displayed cards on the displayed positions of the multi-positional game elements, where the initial poker hand is evaluated by comparing the displayed cards to a poker paytable;

determining if the initial poker hand satisfies a re-roll criterion, where the re-roll criterion is satisfied when the displayed cards on a first portion of the multi-positional game elements correspond to an award in the poker paytable;

when the re-roll criterion is satisfied:

determining a side wager amount to activate a re-roll feature, presenting an option to re-roll a second portion of the multi-positional game elements in exchange for the determined side wager amount, where the second portion of the multi-positional game elements are the remaining multi-positional game elements in the plurality multi-positional game elements that are not in the first portion of multi-positional game elements, randomizing the second portion of multi-positional game elements to display one side of each of the second portion of multi-positional game elements on the game display when a signal is received indicating acceptance of the option to re-roll the second portion of multi-positional game elements in exchange for the side wager amount, and evaluating a secondary poker hand created by the displayed cards on the displayed positions of the first portion of multi-positional game elements and the displayed cards on the displayed positions of the second portion of multi-positional game elements after randomizing the second portion of multi-positional game elements in response to receiving a signal indicating acceptance of the option to re-roll the second portion of multi-positional game elements, where the secondary poker hand is evaluated by comparing the displayed cards to the poker paytable; and provide awards associated with the first game event.

11. The method of claim 10, wherein determining a side wager amount includes dynamically calculating an expected award amount for re-rolling the second portion of the multi-positional game elements.

12. The method of claim 10, wherein determining a side wager amount includes accessing a predetermined fixed amount for the side wager amount.

13. The method of claim 10, wherein determining a side wager amount includes determining a side wager amount based on a number of multi-positional game elements in the second portion of multi-positional game elements that are to be re-rolled.

14. The method of claim 10, wherein determining a side wager amount includes setting the side wager amount to the award in the poker paytable that corresponds to the displayed cards on a first portion of the multi-positional game elements.

15. The method of claim 10, further comprising, when the re-roll criterion is satisfied:

determining if the secondary poker hand satisfies the re-roll criterion; and repeating the determination of a side wager amount to activate a re-roll feature, presentation of an option to re-roll a second portion of the multi-positional game elements, randomization of the second portion of multi-positional game elements, and evaluation of a resulting poker hand when the secondary poker hand satisfies the re-roll criterion.

16. A gaming device comprising:

a game display for displaying game events;

a wager input device structured to receive physical items associated with a currency value;

a memory configured to store a credit value;

a player interface device for receiving inputs related to the game events; and a processor operable to:

receive a signal indicating that a physical item associated with a currency value has been received by the wager input device;

increase the credit amount stored in the memory based on the currency value of the received physical item;

provide a plurality of multi-positional game elements;

select symbols from a plurality of eligible symbols, where the number of symbols selected corresponds to a total number of positions in the plurality of multi-positional game elements;

assign the selected symbols respectively to positions on each of the multi-positional game elements;

randomize the multi-positional game elements to display at least one position of each of the multi-positional game elements, each displayed position associated with a symbol;

evaluate a combination of symbols created by the displayed symbols on the displayed positions of the multi-positional game elements;

determine whether the combination of symbols satisfies a predefined criterion;

re-randomize a second portion of the multi-positional game elements when the predefined criterion is satisfied to generate a final symbol combination, where the second portion of the multi-positional game elements are the remaining multi-positional game elements not in the first portion of the multi-positional game elements; and provide awards associated with the final symbol combination.

17. The gaming device of claim 16, wherein the predefined criterion is satisfied when the displayed symbols on a first portion of the multi-positional game elements correspond to a symbol combination associated with an award in a paytable.

18. The gaming device of claim 16, wherein three six-sided game elements are provided and eighteen symbols are randomly selected from the plurality of eligible symbols.

19. The gaming device of claim 16, wherein five six-sided game elements are provided and thirty symbols are randomly selected from the plurality of eligible symbols.

20. The gaming device of claim 16, wherein the processor is further operable to select new symbols from the plurality of eligible symbols to display on positions of the second portion of multi-positional game elements prior to re-randomizing the second portion of multi-positional game elements.

* * * * *